US006644503B2

(12) United States Patent
Peterson

(10) Patent No.: US 6,644,503 B2
(45) Date of Patent: Nov. 11, 2003

(54) SINGLE PUBLICATION VENDING DEVICE

(76) Inventor: John Peterson, 320 North St., Filer, ID (US) 83328

( * ) Notice: Subject to any disclaimer, the term of this patent is extended or adjusted under 35 U.S.C. 154(b) by 57 days.

(21) Appl. No.: 10/006,322

(22) Filed: Dec. 4, 2001

(65) Prior Publication Data

US 2003/0102325 A1 Jun. 5, 2003

(51) Int. Cl.[7] ..... G07F 11/20; G07F 11/66

(52) U.S. Cl. ..... 221/155; 221/232; 221/244; 221/273; 221/274

(58) Field of Search ..... 221/155, 232, 221/238, 236, 244, 268, 270, 273, 274

(56) References Cited

U.S. PATENT DOCUMENTS

| | | | | | |
|---|---|---|---|---|---|
| 1,047,549 | A | * | 12/1912 | Moffet | 221/36 |
| 1,506,813 | A | * | 9/1924 | Camelo et al. | 194/283 |
| 2,006,100 | A | * | 6/1935 | Hight et al. | 221/42 |
| 2,832,506 | A | * | 4/1958 | Hatcher | 221/103 |
| 3,042,250 | A | | 7/1962 | Watlington | 221/41 |
| 3,136,451 | A | * | 6/1964 | Deane | 221/240 |
| 3,318,478 | A | * | 5/1967 | Hart | 221/227 |
| 4,174,047 | A | | 11/1979 | Owens | 221/154 |
| 4,501,379 | A | * | 2/1985 | Halone et al. | 221/221 |
| 4,566,608 | A | | 1/1986 | Draper et al. | 221/229 |
| 4,583,658 | A | | 4/1986 | Israel | 221/213 |
| 4,655,369 | A | | 4/1987 | Gabriel | 221/213 |
| 4,700,869 | A | * | 10/1987 | Bogner | 221/229 |
| 4,865,178 | A | | 9/1989 | Lewandowski | 194/227 |
| 5,143,251 | A | | 9/1992 | Kahanek et al. | 221/152 |
| 5,178,299 | A | | 1/1993 | Mundt | 221/232 |
| 5,205,437 | A | | 4/1993 | Elder et al. | 221/103 |
| 5,318,195 | A | | 6/1994 | Kahanek et al. | 221/152 |
| 5,431,300 | A | | 7/1995 | Kahanek et al. | 221/151 |
| 5,531,355 | A | | 7/1996 | Ullmann et al. | 221/191 |
| 5,709,315 | A | * | 1/1998 | Kahler et al. | 221/155 |

* cited by examiner

*Primary Examiner*—Donald P. Walsh
*Assistant Examiner*—Daniel K Schlak
(74) *Attorney, Agent, or Firm*—Joseph W. Holland

(57) ABSTRACT

A publication vending device for vending a single publication per vend cycle. The single publication vending device includes a forward transport assembly located within a housing and connected to a carriage for reciprocating movement with the carriage. A the publication is advanced forward through a publication vend port, by operation of the forward transport assembly including. A first finger is positioned laterally to a first edge of the publication and a second finger is positioned laterally to a second edge of the publication. Each of the fingers is forwardly movable with forward operation of the carriage. Each of the fingers is configured for transpositional travel in a plane substantially coplanar to a plane of an interleaf of the publication and towards the centerline of the publication. As the carriage advances forward, the fingers insert between pages of the publication and exert a force against an inner surface of a fold of the publication and the publication advances through a vend port of the housing.

14 Claims, 19 Drawing Sheets

SINGLE PUBLICATION VENDING DEVICE

BACKGROUND OF THE INVENTION

1. Field of the Invention

This invention relates generally to vending devices for vending publications and the like and more specifically to a device for vending a single publication per transaction by exposing only a single publication to the purchaser per transaction.

2. Background

Newspaper vending machines provide a convenient and relatively economic means for selling or distributing newspapers, magazines and the like, herein publication or publications, throughout an area of distribution. Most often, vending machines operate on an honor system, that is, upon payment of a prescribed sum, the vending machine allows a purchaser to access, typically through a manually-operated door, a bay which contains the vending device's remaining stock of publications.

For obvious reasons, this system of vending, based upon an honor system, has over the course of time proven to be problematic to the owner of the vending machine. Problems may arise both due to loss of merchandise and the associated profits from lost sales as well as from increased maintenance costs associated with damage to the machines, much of the internal workings of which are exposed upon opening the door to the vending device.

Although any number of solutions have been proposed, it appears, at least in terms of popular use, that no outstanding solution as been recognized and adopted by machine vendors. The reasons for a lack of adoption of a solution may be numerous. One prevailing reason, however, lies in the complexity and therefore the cost associated with adopting any given proposed solution. Another justification may lie in the fact that many distributors and vendors have significant capital investment in existing vending devices and may be therefor reluctant to invest additionally in any given proposed solution that requires an additional substantial capital investment.

There may be advantage then in providing a single vend device for vending a single publication per transaction by exposing only a single publication to the purchaser per transaction for removal from the vending device.

There may also be advantage in providing a single vend device for vending a single publication per transaction that may be retrofitted into the cabinets of many existing newspaper vending machines.

There may also be advantage in providing a single vend device for vending a single publication per transaction that does not expose the interior of the device to the purchaser during the vend cycle.

SUMMARY

The present invention is directed to a device for vending a single publication per transaction by exposing only a single publication to the purchaser for removal from the vending device during any single vend cycle. The single publication vending device of the present invention may be manufactured as a complete stand alone unit or, in the alternative, various subassemblies of the present invention may be incorporated in an existing publication vending device to retrofit the publication vending device.

In one preferred embodiment of the invention, the single publication vending device includes a product vend assembly positioned within a housing for dispensing a single publication per vend cycle.

In one preferred embodiment of the invention, the single publication vending device includes a housing having a publication vend port, the housing containing a product support platform, the upper surface of the product support platform lying substantially parallel to a plane extending through a generally horizontal midline of the publication vend port. A carriage is connected to and is at least partially contained within the housing. The carriage assembly may be forwardly motivated through a plane lying substantially parallel to a plane extending through a generally horizontal midline of the publication vend port and a publication supported by the product support platform. A forward transport assembly is connected to the carriage for reciprocating movement with the carriage for advancing a publication positioned on the product support platform forward through the publication vend port.

In an alternate preferred embodiment of the invention, the single publication vending device includes the following related components and systems:

a) a housing including a product support platform, a product vend port and an access door;

b) a product storage and elevator assembly;

c) a payment and security system;

d) a carriage assembly;

e) a forward transport assembly; and f) a vend flap assembly.

In an alternate preferred embodiment of the invention, the single publication vending device may also include a product display and release system.

The housing may be configured as a single monolithic cabinet for housing all of the subsystems and component parts of the single publication vending device or in the alternative the housing may include housing subassemblies, for instance a payment and security system sub-housing and a product storage and dispensing sub-housing. The housing includes a product vend port from which a single publication is discharged during a vend cycle. Additionally, the housing may include an access door providing access for stocking product and device maintenance. A publication or a stack of publications may be placed on the product support platform within the housing such that a fold of the publication lies substantially parallel to and is directed towards the vend port of the housing.

A product storage and elevator assembly is positioned within the housing and includes a product elevator to which the product support platform is connected. In one embodiment of the invention, the product elevator may also be responsive to one or more springs providing a vertical up bias for the product elevator and the product support platform against a vertical lift stop. The product elevator is also responsive to operation of the door to lower the product elevator to permit access to the product support platform.

In one embodiment of the invention, the payment and security system includes a payment receipt mechanism combined with a latch assembly. The payment receipt mechanism may be configured to receive payment by coin or paper currency and may or may not be configured to provide change or return of payment. In the alternative the payment receipt mechanism may be configured to accept credit or debit payment by electronic means. All of the above configurations for a payment receipt mechanism are currently known to those skilled in the art. The payment receipt mechanism may also include secure cash storage or other means for storing or transmitting payment data.

In a secure mode, the latch assembly secures the vending device and prohibits operation of the product vend assembly. Regardless of the particular configuration of the payment receipt mechanism, upon payment of a prescribed sum, the payment receipt mechanism cooperates with the latch assembly disabling a latch which otherwise restricts operation of the product vend assembly. Once the latch releases, the product vend assembly becomes operable and a vend cycle may be initiated.

In one embodiment of the invention, a product vend assembly includes a carriage assembly and a forward transport assembly. The forward transport assembly is supported by the carriage assembly. In addition, the carriage assembly provides motivation for the forward transport assembly. In one embodiment of the invention, the carriage assembly includes first and second carriage members which are slideable through support bushings. The first and second carriage members are joined by a crossbar which is operable by a purchaser to motivate the carriage in a generally forward direction. Alternately, forward motivation for the carriage may be provided by a motor or by electrical or electromechanical means.

The forward transport assembly is connected to the carriage for reciprocating movement with the carriage for advancing the publication forward through the publication vend port. The forward transport assembly includes a first advance arm connected to the first carriage member, the first advance arm including a first finger positioned laterally to a first edge of the uppermost publication positioned on the product support platform against the vertical lift stop. The forward transport assembly also includes a second advance arm connected to the second carriage member, the second advance arm including a second finger positioned laterally to a second edge of the uppermost publication positioned on the product support platform. The first and second fingers project angularly towards a centerline of the publication from a distal or forward end of the first and second advance arms respectively. When the carriage and the attached first and second advance arm assemblies are moved forward, the forward ends of the first and second advance arms transpose from a first position lying along a line parallel to a first side edge of the publication to a second position lying along a second line parallel to a side edge of the publication. Transpositional travel may be characterized by a substantially diagonal path in a plane substantially coplanar to the plane of the interleaf and towards the centerline of the publication. The first and second fingers transpose by travelling diagonally towards a centerline of the publication in a pair of guides or tracks. As the carriage moves forward, the first and second fingers insert at an interleaf formed between adjacent pages or page sections of the uppermost publication. The first and second fingers, upon contact with an internal surface of the fold, exert a force against the internal surface of the fold motivating the uppermost publication towards the publication vend port for discharge from the vending device.

Motivation for rearward carriage travel is provided by first and second carriage return springs which are connected to the housing or frame member and the first and second carriage members respectively. As the first and second carriage members complete their rearward travel, the crossbar returns to a normal or first position, and the latch is once again engaged disabling or otherwise restricting further operation of the product vend assembly.

A vend flap assembly may function in conjunction with the product vend assembly to permit access to a single publication during a vend mode or cycle and to inhibit access to publications stored in the device through the publication vend port when the device is in a secure mode. The vend flap assembly includes a vend flap that hingedly covers the publication vend port. The vend flap is attached to the housing by a flap hinge which is biased to a closed or secure mode position by a flap spring. The vend flap assembly may also include a flap latch assembly which, when the vend flap is in a closed or secure mode position prohibits opening of the flap. During the vend cycle, the flap latch assembly is tripped allowing the vend flap to be urged open.

The single publication vending device may also include a door which is secured and operable to gain access to the interior of the housing to place and remove publications in the device and to maintain, adjust and service the device.

In one preferred embodiment of the invention, the single publication vending device also includes a product display and release system. The product display release system includes a product display bay having a window to display a display publication available for sale. A display publication support is hingedly attached to the door forming a lower support surface for supporting a publication in the product display bay. The product support is held in support position by a retainer attached to a trip lever. As publications are sold the product elevator continues to lift, positioning the top publication for vending. The trip lever is positioned such that as the last publication is sold and the elevator reaches a preselected elevation, the elevator lifts against the trip lever releasing the retainer which in turn permits the display publication to drop out of the product display bay into the bottom of the housing. A sold out sign may be displayed behind the display publication, visible only when the display publication drops from the product display bay.

DETAILED DESCRIPTION OF THE INVENTION

Figure 1:
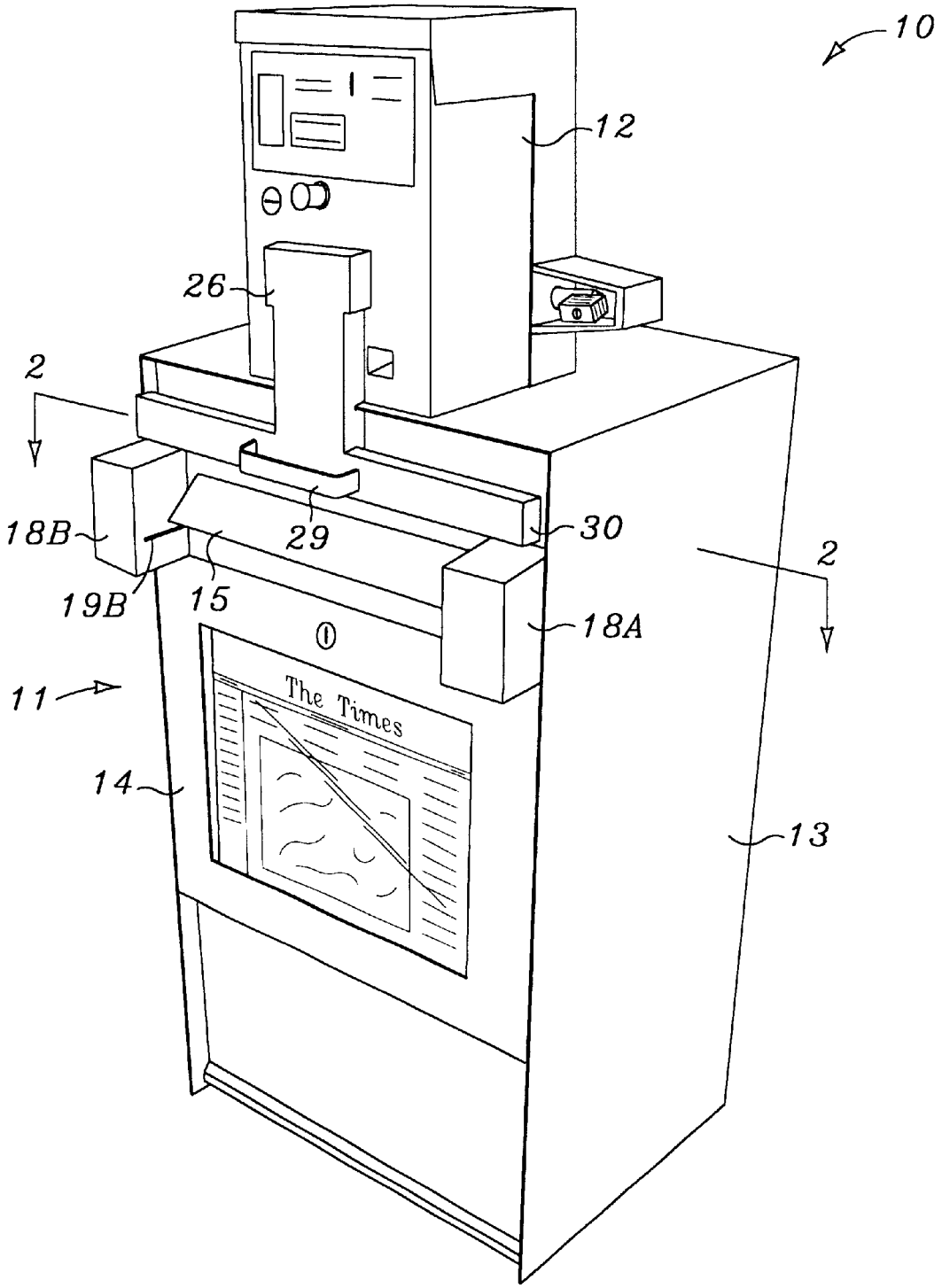
FIG. 1 is a perspective representation of one embodiment of a single publication vending device.

FIG. 1 shows single publication vending device 10 including housing 11, including in this embodiment, payment and security system sub-housing 12 and product storage and dispensing sub-housing 13. Door 14 is hingedly attached to product storage and dispensing sub-housing 13. Payment and security system sub-housing 12 provides security for a payment and security system.

Also shown in FIG. 1 is crossbar 30 including hasp portion 26 which is connected to and extends from crossbar 30 for latching cooperation with a payment and security system contained within payment and security system sub-housing 12. Crossbar 30 includes pull 29 which provides a point at which the purchaser may grasp and pull crossbar 30 forward following payment as more fully described herein. Also shown to advantage in FIG. 1 are first and second advance arm housings 18A and 18B which provide protection for elements of the forward transport assemblies during travel. Also shown to advantage in FIG. 1 is first finger slot 19B which provides a path of egress accommodating travel of the forward transport assemblies. Drip shield 15 inhibits entry of rain or snow into single publication vending device 10.

FIGS. 2 through 6 are top views showing carriage assembly 20 and first and second forward transport assemblies, 40A and 40B respectively, contained within housing 11 of single publication vending device 10. Publication P having a centerline C, fold F and inner fold surface S, is shown supported on product support platform 51. Bin 97 is connected to the interior of product storage and dispensing sub-housing 13 at brackets 98A and 98B and extends vertically about product support platform 51 providing a three wall containment and alignment means for publication P. An upper elevation publication P is established by first and second upper limit stops 31A and 31B. First and second upper limit stops 31A and 31B may be adjusted up or down as necessary to assure a proper elevation of publication P. Ideally, first and second upper limit stops 31A and 31B may be adjusted to accommodate a range of thickness for publication P which is often the case for any given newspaper throughout the course of any given week. Preferably, first and second upper limit stops 31A and 31B are adjusted to accommodate the thinnest publication dispensed. This is accomplished by setting first and second upper limit stops 31A and 31B so that first finger 46A and second finger 46B insert at a publication interleaf formed between adjacent pages of near the uppermost surface of publication P, yet within the thickness of the thinnest publication P dispensed.

FIGS. 2 through 6 also show payment and security system sub-housing 12 superimposed on product storage and dispensing sub-housing 13. Also shown to advantage in FIGS. 2 through 6 are first and second advance arm housings 18A and 18B which provide protection for first arm 41A and second arm 41B during forward travel, and first and second finger slots 19A and 19B which provide a path of egress accommodating travel of first and second fingers 46A and 46B respectively.

Carriage assembly 20 includes first carriage member 21A and second carriage member 21B which are slidingly disposed through and connected to product storage and dispensing sub-housing 13 by forward guide rail bushings 22A and 22B and rear guide rail bushings 23A and 23B. First carriage member 21A and second carriage member 21B are joined by crossbar 30 at their respective distal or forward ends. A carriage forward advance in the form of crossbar 30 provides forward motivation for first carriage member 21A and second carriage member 21B when pulled by the purchaser. Crossbar 30 includes pull 29 which provides a point at which the purchaser may grasp and pull crossbar 30. First carriage member 21A includes first carriage member stop 24A and second carriage member 21B includes second carriage member stop 24B for limiting forward travel of first carriage member 21A and second carriage member 21B respectively.

A carriage return in the form of first carriage return spring 25A and second carriage return spring 25B provide rearward motivation for carriage assembly 20. Rearward motivation for first carriage member 21A and second carriage member 21B is provided by first carriage return spring 25A, a first end of which attaches to first forward transport assembly 40A and a second end of which attaches to an inner surface of product storage and dispensing sub-housing 13. Rearward motivation for second carriage member 21B is provided by second carriage return spring 25B, a first end of which attaches to second forward transport assembly 40B and a second end of which attaches to an inner surface of product storage and dispensing sub-housing 13.

Latch 27 attaches to the inner face of hasp portion 26 which interfaces with payment and security system sub-housing 12 and its enclosed coin operated latch assembly 67. Latch 27 is selectively operable by coin operated latch assembly 67 between a secure mode prohibiting operation of carriage 20 and a vend cycle wherein operation of carriage 20 is permitted. Carriage 20 also includes first advance arm connector 28A and second advance arm connector 28B to which first and second forward transport assemblies 40A and 40B are connected respectively.

FIGS. 2 through 6 also show select component parts of both first and second forward transport assemblies 40A and 40B. First forward transport assembly 40A includes first advance arm 41A which is rotatably connected to first carriage member 21A at first advance arm connector 28A, for reciprocating movement along first advance arm track 42A with the forward and rearward movement of first carriage member 21A. First advance arm 41A includes first finger 46A extending angularly from the distal or forward end of first advance arm 41A towards centerline C of publication P. Similarly, second forward transport assembly 40B includes second advance arm 41B which is rotatably connected to second carriage member 21B at second advance arm connector 28B, for reciprocating movement along second advance arm track 42B with the forward and rearward movement of second carriage member 21B. Second advance arm 41B includes second finger 46B extending angularly from the distal end of second advance arm 41B towards centerline C of publication P.

Figure 7A:
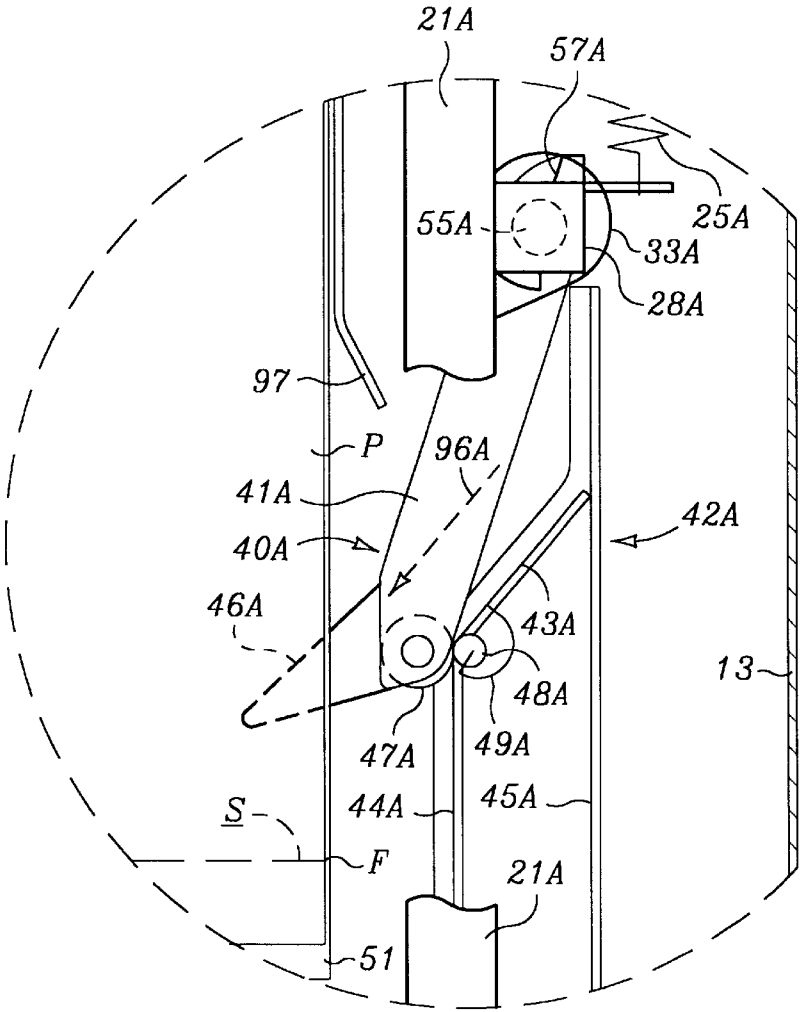
FIGS. 7A and 7B are representative top detail views showing the advance arm assemblies for the single publication vending device.
Figure 7B:
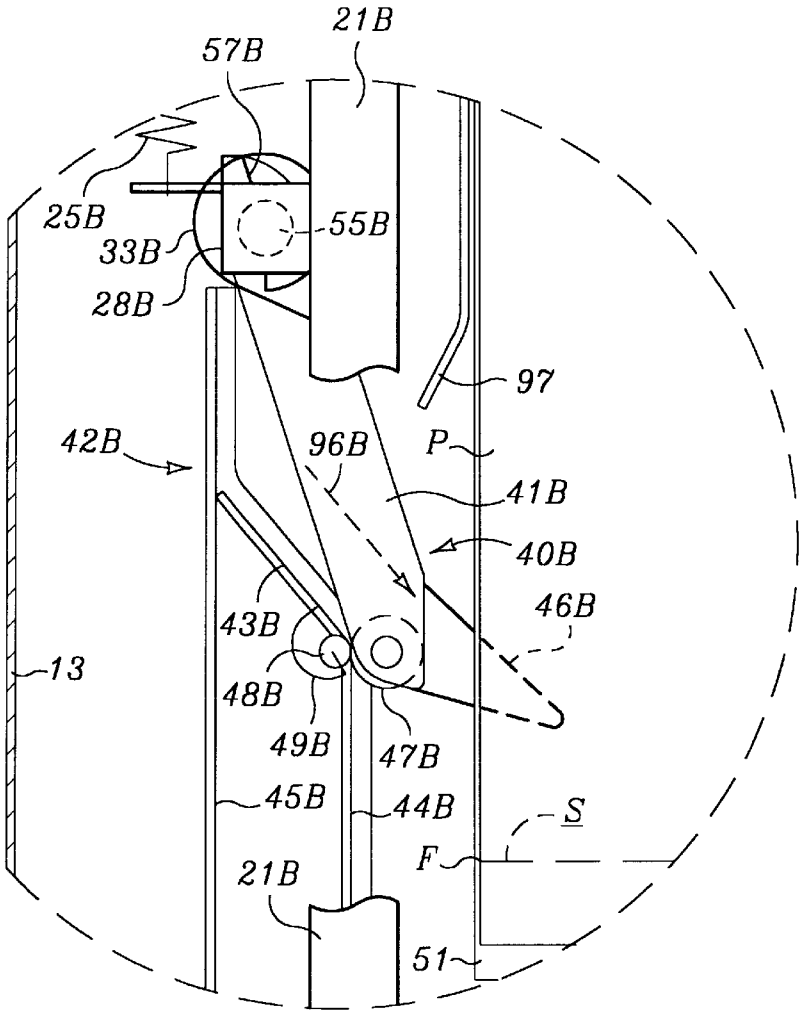

FIGS. 7A and 7B are detail views showing various features and aspects of first and second forward transport assemblies 40A and 40B respectively.

First forward transport assembly 40A, shown in FIG. 7A, includes first advance arm 41A which is rotatably connected to first carriage member 21A at first pivot point 55A by first advance arm connector 28A, for reciprocating movement along first advance arm track 42A with the forward and rearward movement of first carriage member 21A. First advance arm 41A includes first finger 46A extending from the distal end of first advance arm 41A towards an edge of publication P. Also attached near a distal end of first advance arm 41A is first advance arm roller 47A, which is in rolling contact with first advance arm track 42A. Over rotation stop 57A assures that first advance arm 41A and first finger 46A do not rotate past a point of optimum engagement of the leading edge of first finger 46A with inner surface S of fold F. Bin 97 provides a containment and alignment means for publication P.

Similarly, second forward transport assembly 40B, shown in FIG. 7B, includes second advance arm 41B which is rotatably connected to second carriage member 21B at second pivot point 55B by second advance arm connector 28B, for reciprocating movement along second advance arm track 42B with the forward and rearward movement of second carriage member 21B. Second advance arm 41B includes second finger 46B extending from the distal end of second advance arm 41B towards an edge of publication P. Also attached near a distal end of second advance arm 41B is second advance arm roller 47B, which is in rolling contact with second advance arm track 42B. Over rotation stop 57B assures that second advance arm 41B and second finger 46B do not rotate past a point of optimum engagement of the leading edge of second finger 46B with inner surface S of fold F. Bin 97 provides a containment and alignment means for publication P.

Figure 6:
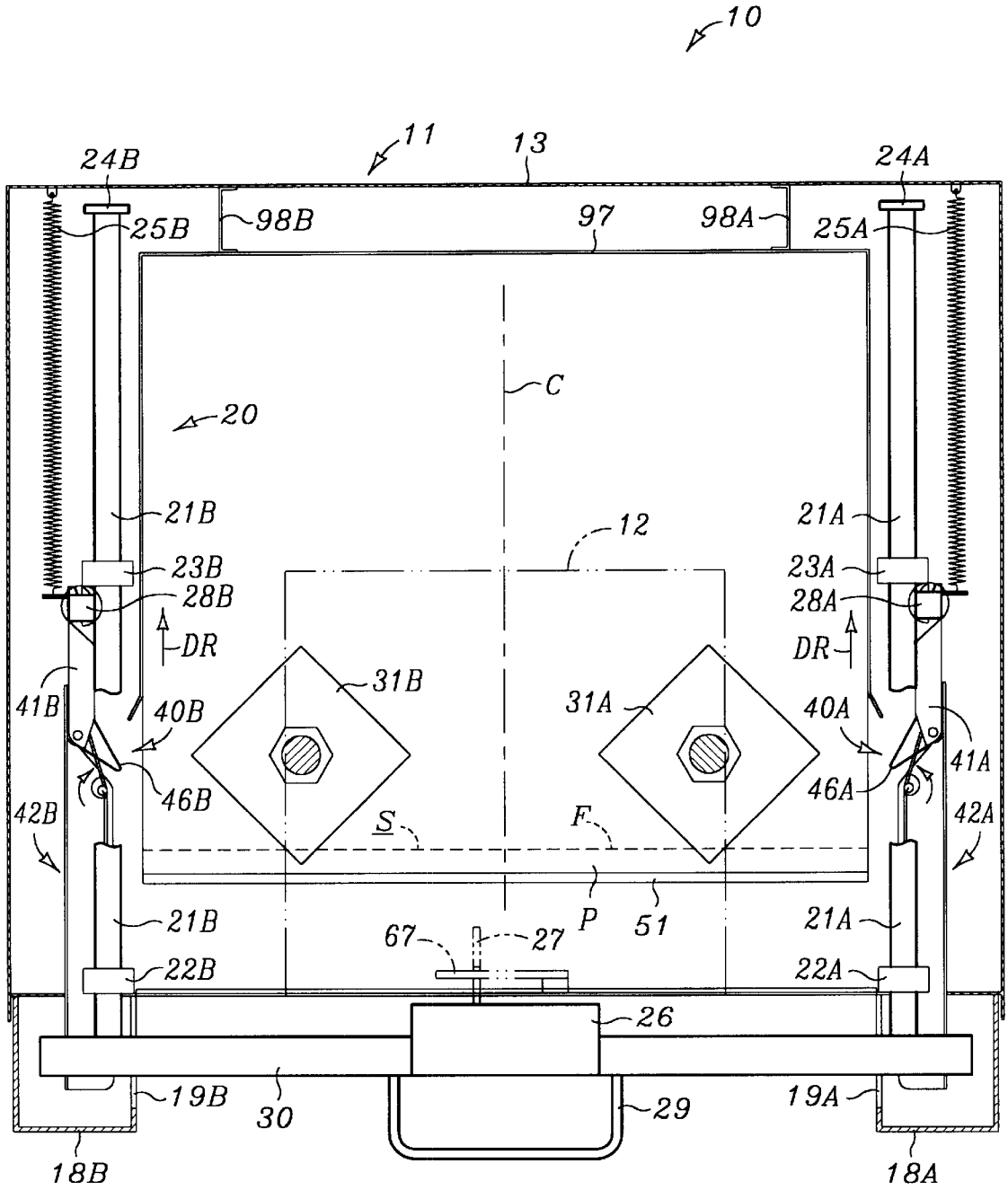

First advance arm track 42A, shown in FIG. 7A, includes first diagonal delivery track portion 43A, first parallel delivery track portion 44A and first return track portion 45A. First diagonal delivery track portion 43A is hingedley attached to first parallel delivery track portion 44A at first return hinge 48A. First diagonal delivery track portion 43A is biased towards a closed position by first return gate spring 49A and is configured to permit passage of first advance arm roller 47A as shown in FIG. 6 and more fully described herein. First advance arm roller 47A of first advance arm 41A tracks along first diagonal delivery track portion 43A and first parallel delivery track portion 44A as first carriage member 21A is pulled forward. First advance arm 41A is pivotally connected to first carriage member 21A by first advance arm connector 28A in such a manner that first advance arm 41A is biased to rotation about first advance arm connector 28A by tensioner 33A in a direction generally away from the centerline C of publication P.

Second advance arm track 42B, shown in FIG. 7B, includes second diagonal delivery track portion 43B, second parallel delivery track portion 44B and second return track portion 45B. Second diagonal delivery track portion 43B is hingedley attached to second parallel delivery track portion 44B at second return hinge 48B. Second diagonal delivery track portion 43B is biased towards a closed position by second return gate spring 49B and is configured to permit passage of second advance arm roller 47B as shown in FIG. 6 and more fully described herein. Second advance arm roller 47B of second advance arm 41B tracks along second diagonal delivery track portion 43B and second parallel delivery track portion 44B as second carriage member 21B is pulled forward. Second advance arm 41B is pivotally connected to second carriage member 21B by second advance arm connector 28B in such a manner that second advance arm 41B is biased to rotation about second advance arm connector 28B by tensioner 33B in a direction generally away from the centerline C of publication P.

Also shown to advantage in FIG. 7A is first carriage return spring 25A, a first end of which is attached at a proximate end of first advance arm 41A and is contained within product storage and dispensing sub-housing 13. Similarly, as shown 7B, second carriage return spring 25B is attached at a proximate end of second advance arm 41B and is contained within product storage and dispensing sub-housing 13. Publication P is shown positioned on product support platform 51.

Figure 2:
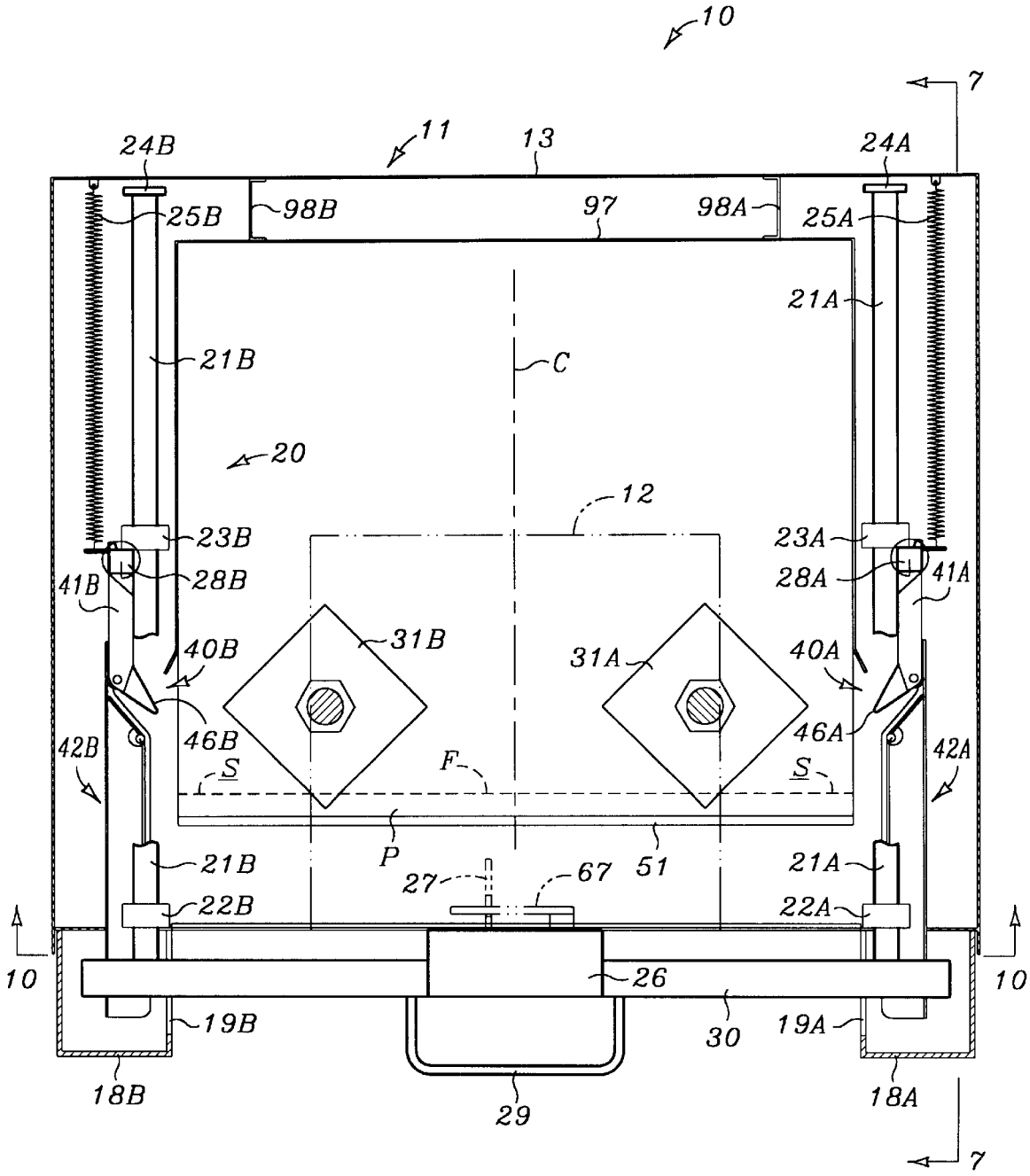
FIGS. 2 through 6 are representative top views showing a carriage and a forward transport assembly for a single publication vending device.

Referring to FIGS. 2, 7A and 7B, operation of carriage assembly 20 and first and second forward transport assemblies, 40A and 40B is more fully described. As first and second advance arms 41A and 41B advance along first and second diagonal delivery track portions 43A and 43B respectively, the distal end of first advance arm 41A with its extending first finger 46A and the distal end of second advance arm 41B with its extending second finger 46B traverse a substantially diagonal path towards centerline C of publication P. Diagonal path 96A traveled by first advance arm 41A with its attached first finger 46A is shown in FIG. 7A and diagonal path 96B traveled by second advance arm 41B with its attached second finger 46B is shown in FIG. 7B.

Figure 3:
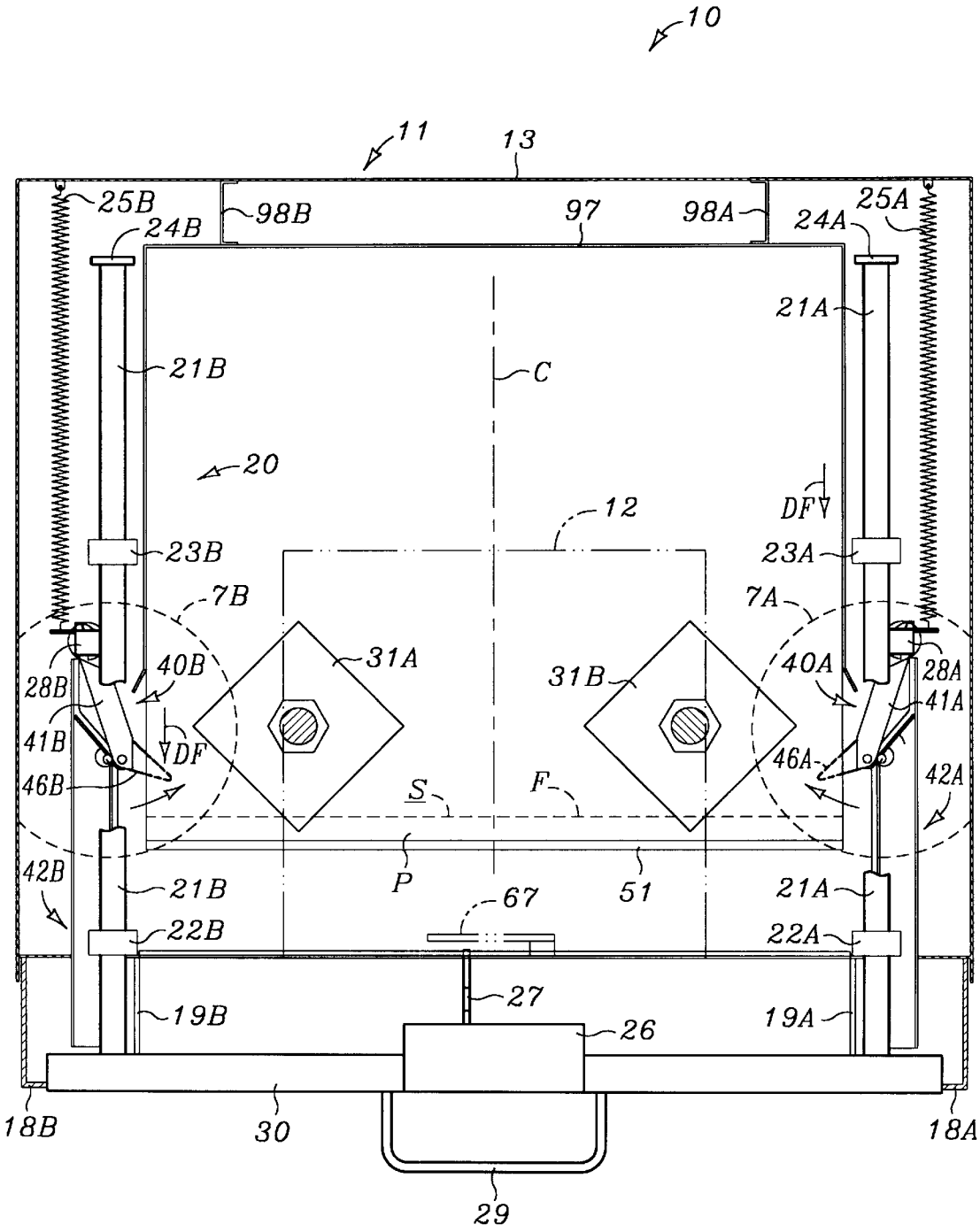
Figure 4:
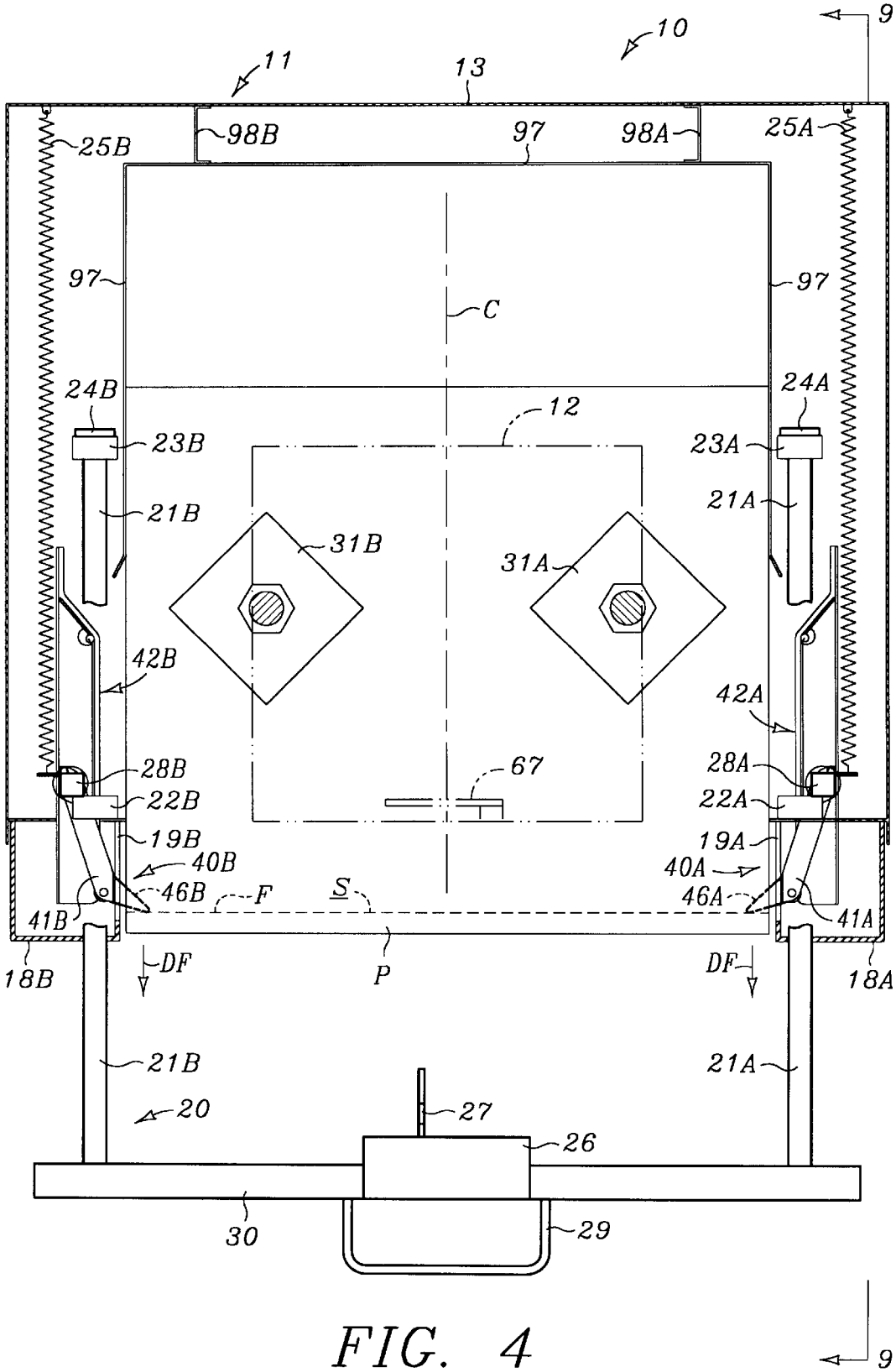

As shown in FIGS. 3 and 4, as first and second advance arms 41A and 41B advance along first and second advance arm tracks 42A and 42B respectively, the distal end of first advance arm 41A with its extending first finger 46A and the distal end of second advance arm 41B with its extending second finger 46B traverse a substantially forward course along a path that lies substantially parallel to a first side edge of publication P with first finger 46A and second finger 46B approaching inner surface S of fold F of publication P. As shown in FIG. 4, as first advance arm 41A continues travel along first advance arm track 42A, first finger 46A exerts a force at inner fold surface S of publication P urging publication in forward direction DF. As shown in FIG. 4, forward movement of first and second advance arms 41A and 41B have been accommodated and protected by first advance arm housing 18A and second advance arm housing 18B. Forward and lateral passage of first and second fingers 46A and 46B are accommodated by first and second finger extension slots 19A and 19B.

Figure 5:
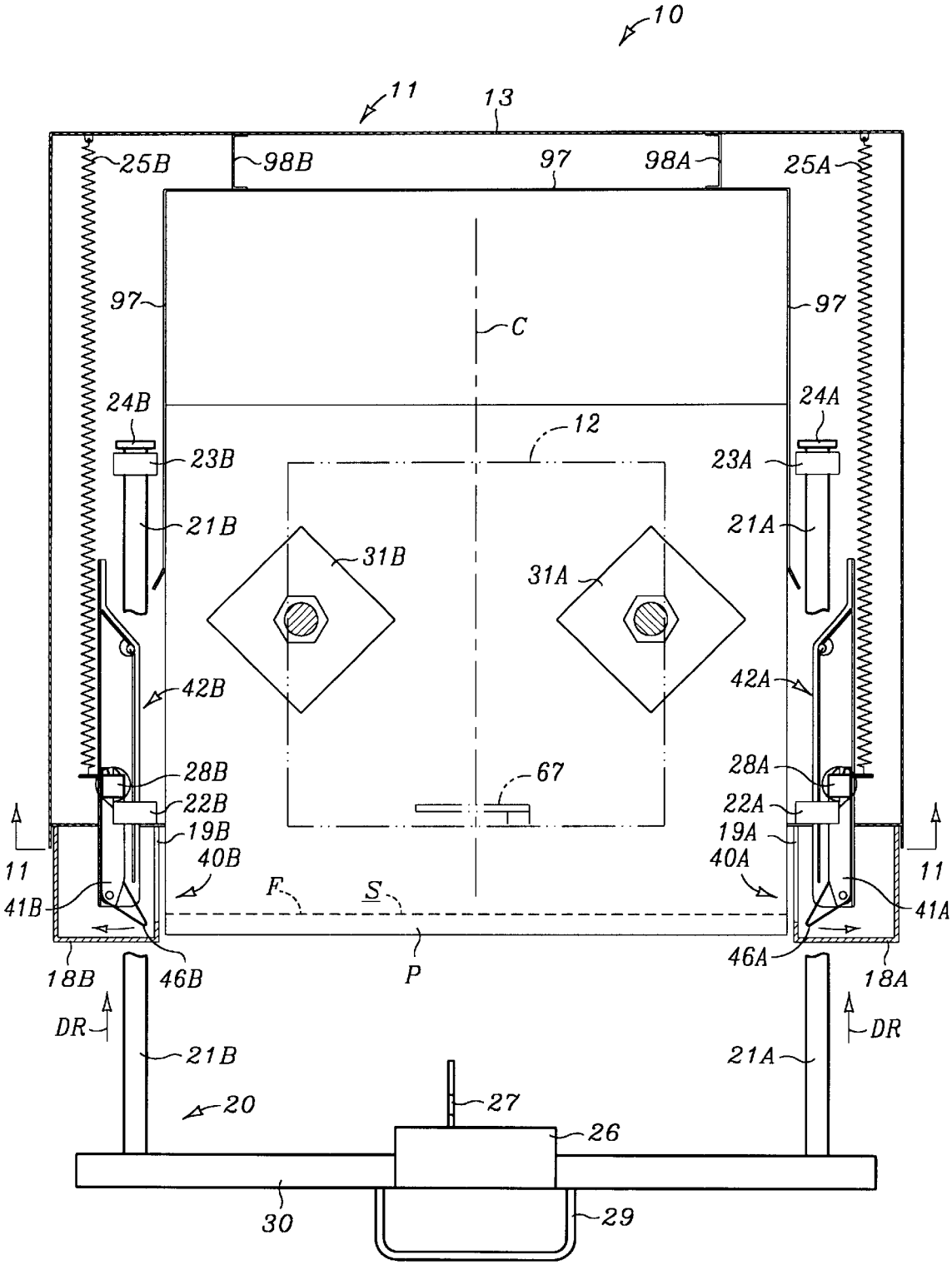

As shown in FIG. 5, as first and second advance arms 41A and 41B have reached a point of forwardmost travel, and being biased to rotation respectively about first advance arm connector 28A and second advance arm connector 28B in a direction generally away from the centerline C of publication P, first and second advance arms 41A and 41B enter first and second return track portions 45A and 45B. First carriage member 21A initiates travel in a rearward direction DR as first carriage return spring 25A contracts and the attached first advance arm 41A travels along first return track portion 45A. Similarly, second carriage member 21B initiates travel in a rearward direction DR as second carriage return spring 25B contracts and the attached second advance arm 41B travels along second return track portion 45B. FIGS. 4 and 5 show publication P advanced forward through publication vend port 16 for removal by a purchaser.

Figure 8:
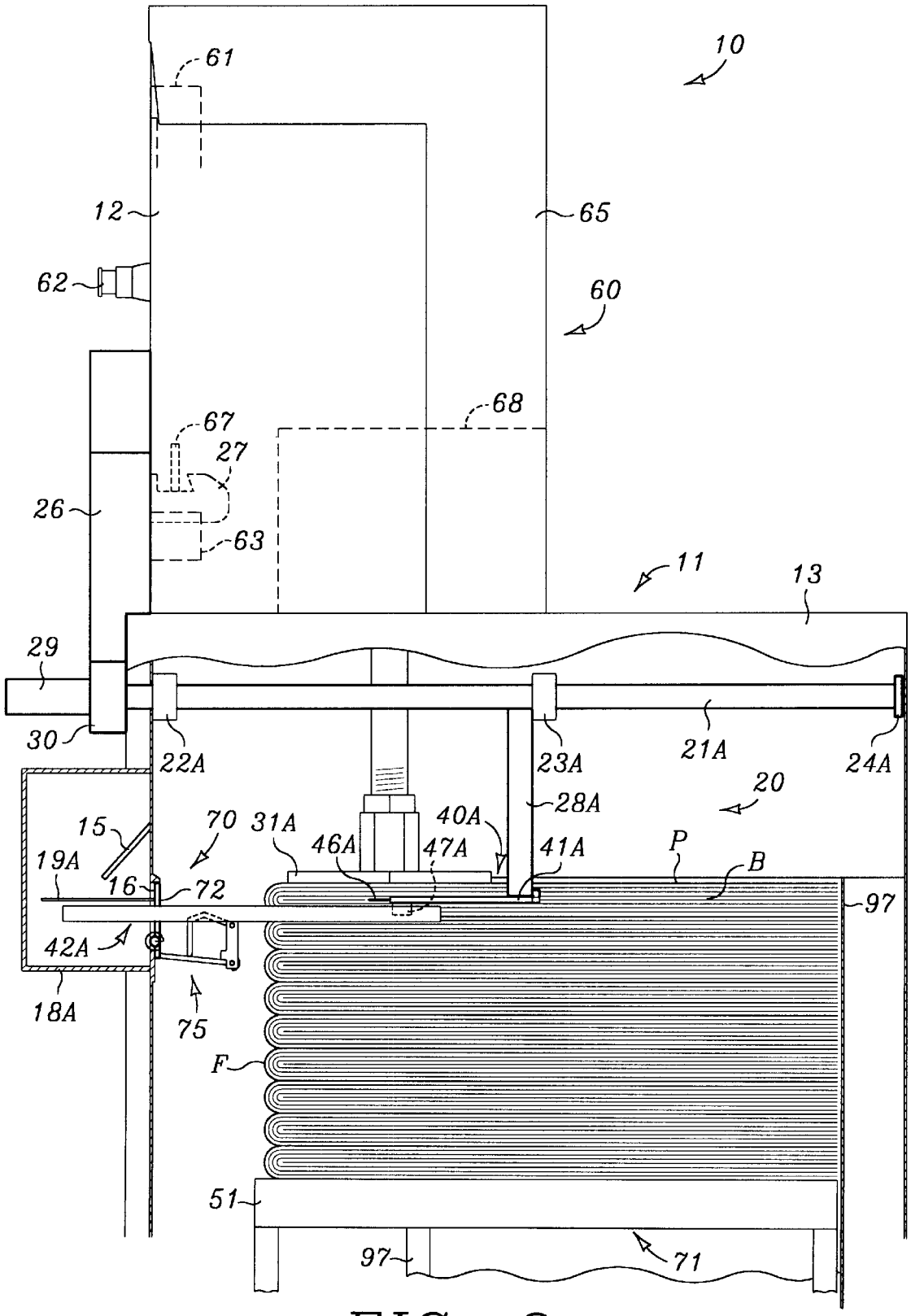
FIG. 8 is a representative cross-sectional side view showing a carriage and a forward transport assembly for a single publication vending device.

Referring to FIG. 6, as first and second advance arms 41A and 41B return along first advance arm track 42A and second return track portion 42B they pass through first diagonal delivery track portion 43A, shown in FIG. 7A, and second diagonal delivery track portions 43B, shown in FIG. 7B, which are hingedley attached to first parallel delivery track portion 44A, shown in FIG. 7A, and second parallel delivery track portion 44B, shown in FIG. 7B. First diagonal delivery track portion 43A, shown in FIG. 7A, and second diagonal delivery track portion 43B, shown in FIG. 7B, are biased towards a closed position as shown in FIGS. 2 through 5 and 7A and 7B, by first return gate spring 49A, shown in FIG. 7A and second return gate spring 49B, shown in FIG. 7B. Rearward travel of first and second advance arms 41A and 41B is limited when hasp portion 26 contacts a front face of payment and security system sub-housing 12, as can be seen in FIG. 8. When rearward travel is complete, carriage assembly 20 and first and second forward transport assemblies 40A and 40B are said to be at a first position, as shown in FIGS. 2 and 6, wherein latch 27 is secured and forward movement of carriage 20 is prohibited.

Figure 9:
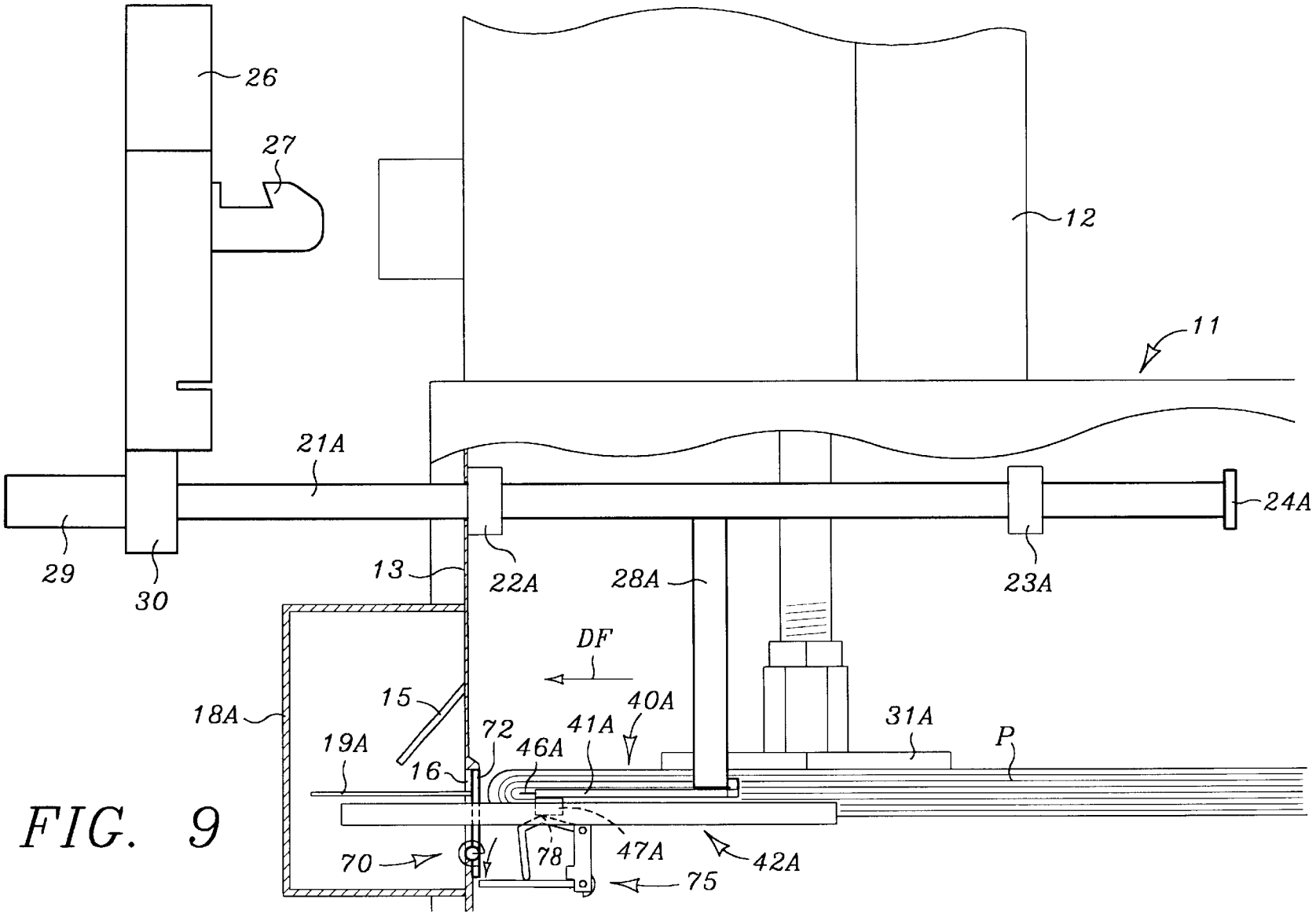
FIGS. 9 and 10 are representative cross-sectional detail side views showing a carriage and a forward transport assembly for a single publication vending device.
Figure 10:
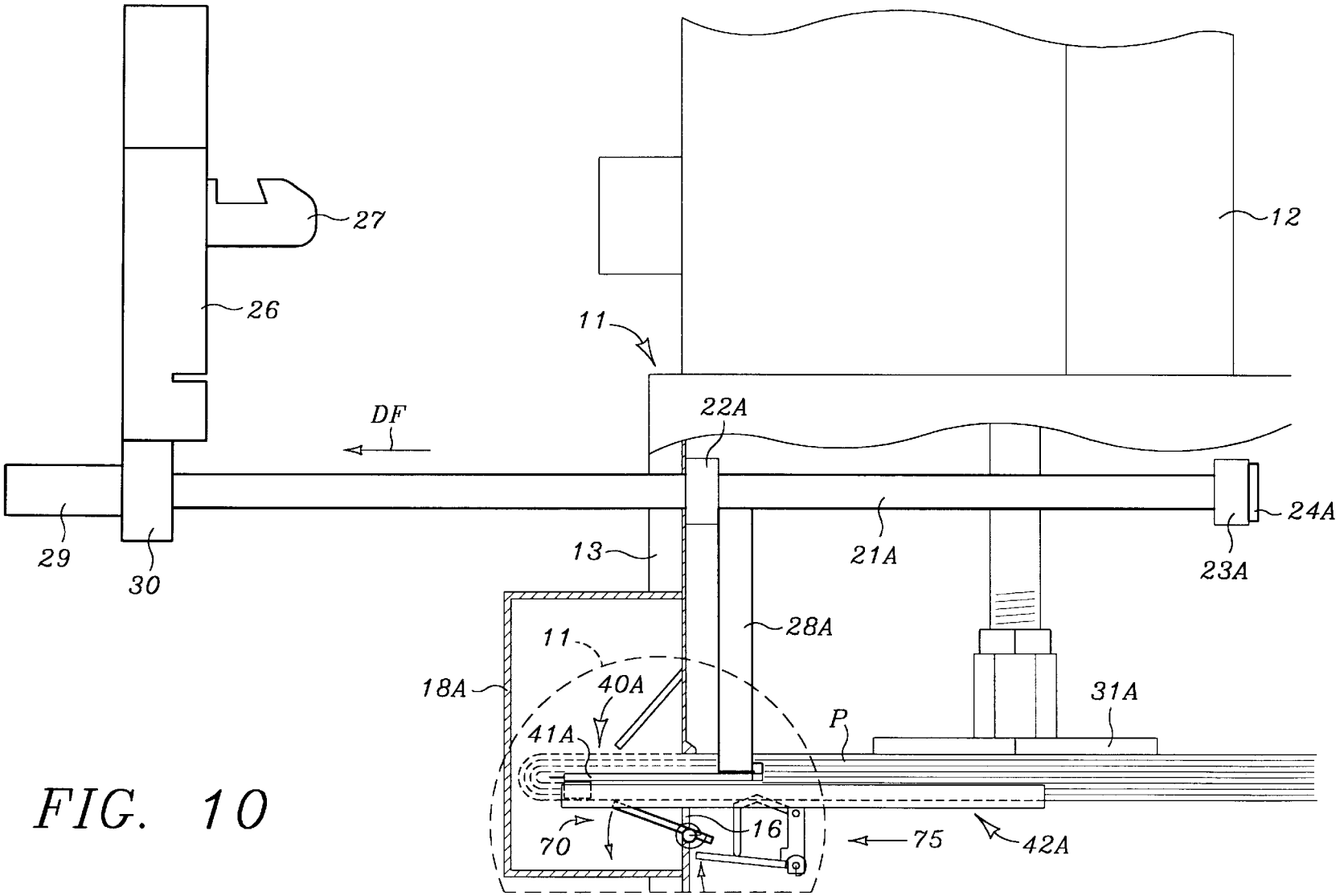

FIGS. 8 through 10 show single publication vending device 10 including housing 11, including in this embodiment, payment and security system sub-housing 12 and product storage and dispensing sub-housing 13. Housing 11 also includes publication vend port 16, through which publication P is discharged during a vend cycle. First advance arm housing 18A provides protection for first advance arm 41A during travel as more fully described herein. FIGS. 8 through 10 also show first finger slot 19A which provides a path of egress accommodating travel of first finger 46A. Drip shield 15 inhibits entry of rain or snow through publication vend port 16. FIGS. 8 through 10 also show first upper limit stop 31A which establishes an upper elevation for the uppermost surface of publication P.

FIG. 8 shows publication P supported by product support platform 51 which supports and positions one or more publications P such that fold F of publication P lies substantially parallel to and coplanar with publication vend port 16. Bin 97 provides a containment and alignment means for publication P.

Referring to FIGS. 9 and 10, first carriage member 21A is slidingly disposed through and connected to product storage and dispensing sub-housing 13 by forward guide rail bushing 22A and rear guide rail bushing 23A. Crossbar 30 is shown connected at the distal end of first carriage member 21A. Crossbar 30 includes pull 29 which provides a point at which the purchaser may grasp and pull crossbar 30. First carriage member 21A includes first carriage member stop 24A for limiting forward travel of first carriage member 21A. Rearward motivation for first carriage member 21A is provided by first carriage return spring 25A (shown in FIGS. 2–6) attached between first forward transport assembly 40A and an inner surface of product storage and dispensing sub-housing 13.

As can be seen, latch 27 attaches to the inner face of hasp portion 26 which interfaces with payment and security system sub-housing 12.

Referring to FIGS. 6, 7A and 7B, it is important that proper setup and timing of the latching of carriage assembly 20 by latch 27 with the return of first and second advance arms 41A and 41B through first and second advance arm tracks 42A and 42B respectively, and through first diagonal delivery track portion 43A, shown in FIG. 7A, and second diagonal delivery track portion 43B, shown in FIG. 7B, be observed. Preferably, latch 27 should be engaged with coin operated latch assembly 67 prior to the complete return of first and second advance arms 41A and 41B through first diagonal delivery track portion 43A, shown in FIG. 7A, and second diagonal delivery track portion 43B, shown in FIG. 7B, so that the vend cycle may not be initiated or repeated until such time as a prescribed purchase price has been deposited and coin operated latch assembly 67 once again releases latch 27.

Referring again to FIGS. 8 through 10, first forward transport assembly 40A is shown including first advance arm 41A which is rotatably connected to first carriage member 21A by first advance arm connector 28A for reciprocating movement along first advance arm track 42A with the forward and rearward movement of first carriage member 21A. As shown in FIG. 10, first advance arm 41A includes first finger 46A extending from the distal end of first advance arm 41A for insertion at publication interleaf B formed between adjacent pages of publication P. Also attached near a distal end of first advance arm 41A is first advance arm roller 47A which is in rolling contact with first advance arm track 42A.

Also shown in FIGS. 8 through 10 is upper travel limit 31A which assures that the elevation of the uppermost publication P is always consistent. Upper travel limit 31A may be adjustable to accommodate varying ranges of thickness of publication P for vending. Referring to FIG. 8, publication P is supported by product support platform 51 which supports and positions one or more publications P such that fold F of publication P lies substantially parallel to and coplanar with publication vend port 16.

Also shown in FIG. 8 to advantage is payment and security system 60 which is enclosed within payment and security system sub-housing 12 and includes coin slot 61 through which coins are placed for passage to latch assembly 67. Latch assembly 67 releases latch 27 upon payment of a prescribed sum. Payment and security system 60 includes coin return button 62, coin return slot 63 and lockbox access panel 65. Padlock 66, (shown in FIG. 12), secures payment and security system 60 including coinbox 68 within payment and security system sub-housing 12. Also shown to advantage in FIGS. 8 through 10 are vend flap assembly 70 including vend flap 72 and flap latch assembly 75.

Figure 11:
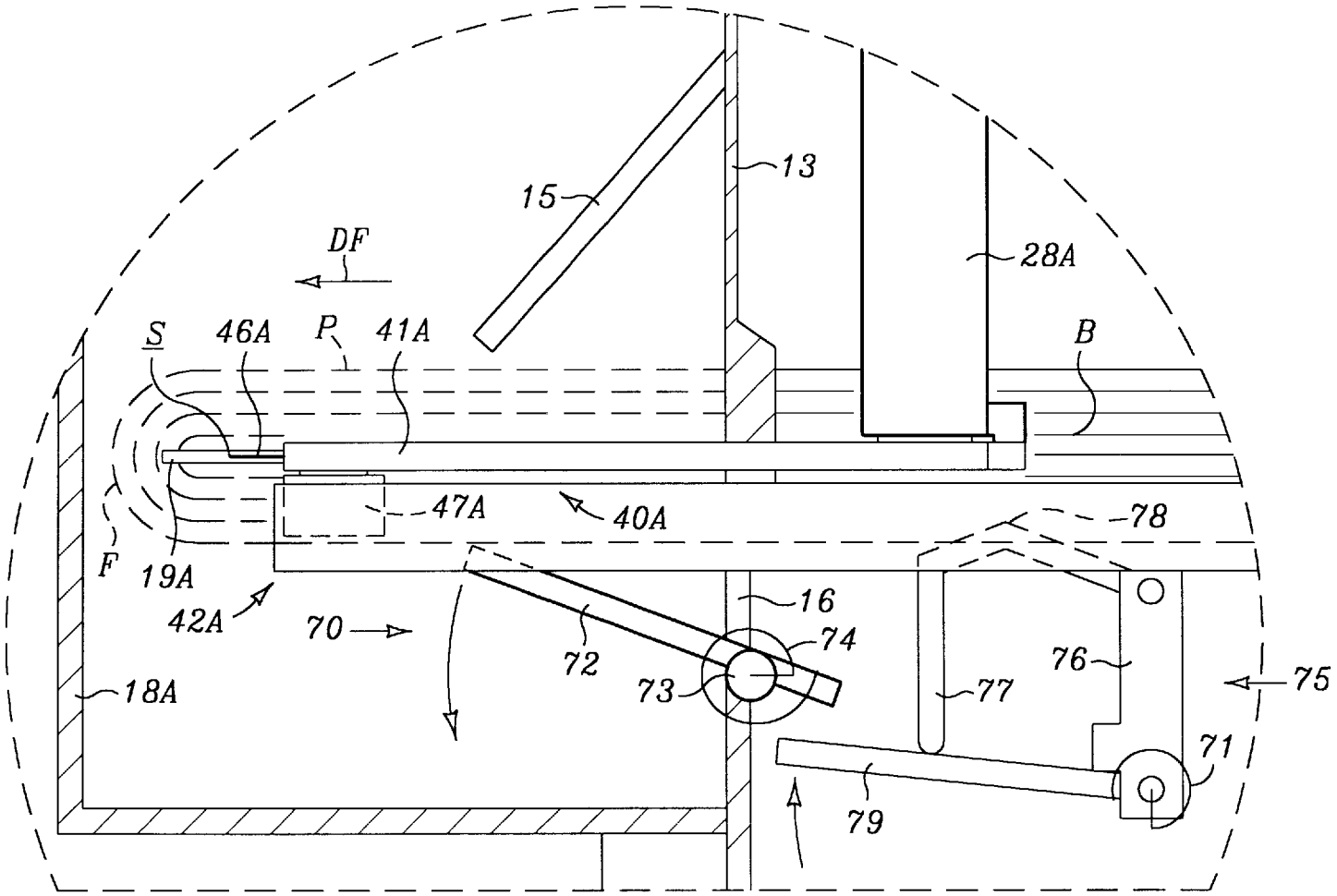
FIG. 11 is a representative cross-sectional side view detail showing a flap latch assembly for a single publication vending device.

FIG. 11 shows first forward transport assembly 40A enclosed in product storage and dispensing sub-housing 13. Drip shield 15 inhibits entry of rain or snow into single publication vending device 10 at publication vend port 16. First forward transport assembly 40A includes first advance arm 41A rotatably connected to first advance arm connector 28A. As shown in FIG. 11, first advance arm 41A includes first finger 46A extending from the distal end of first advance arm 41A. First finger 46A inserts at publication interleaf B formed between adjacent pages of publication P. Publication P includes fold F having inner fold surface S against which first finger 46A exerts a forward pressure as advance arm 41A moves in forward direction DF. Advance arm 41A is shown in an advanced forward position and enclosed within first advance arm housing 18A. First finger 46A is shown extending through first finger slot 19A. Also attached near a distal end of first advance arm 41A is first advance arm roller 47A which is in rolling contact with first advance arm track 42A.

FIG. 11 also shows to advantage vend flap assembly 70 and flap latch assembly 75. Vend flap assembly 70 includes vend flap 72 that hingedly covers publication vend port 16. Vend flap 72 is attached to housing 11 by flap hinge 73 which is biased to a closed or secure mode position by flap spring 74. Vend flap assembly 70 may also include flap latch assembly 75 which, when vend flap 72 is in a closed or secure mode position, prohibits opening of vend flap 72.

Flap latch assembly 75 includes flap latch body 76 which is positioned below first advance arm track 42A. Flap latch trip 77 is pivotally attached to flap latch body 76 and is configured to interfere with the passage of first advance arm roller 47A as it advances along first advance arm track 42A during forward movement. As advance arm roller 47A depresses flap latch lobe 78, as shown in FIG. 9, flap latch trip 77 releases flap catch 79 permitting vend flap 72 to pivot open against the force of the forward moving publication P. Flap catch 79 is biased towards an up position by spring 71.

Figure 12:
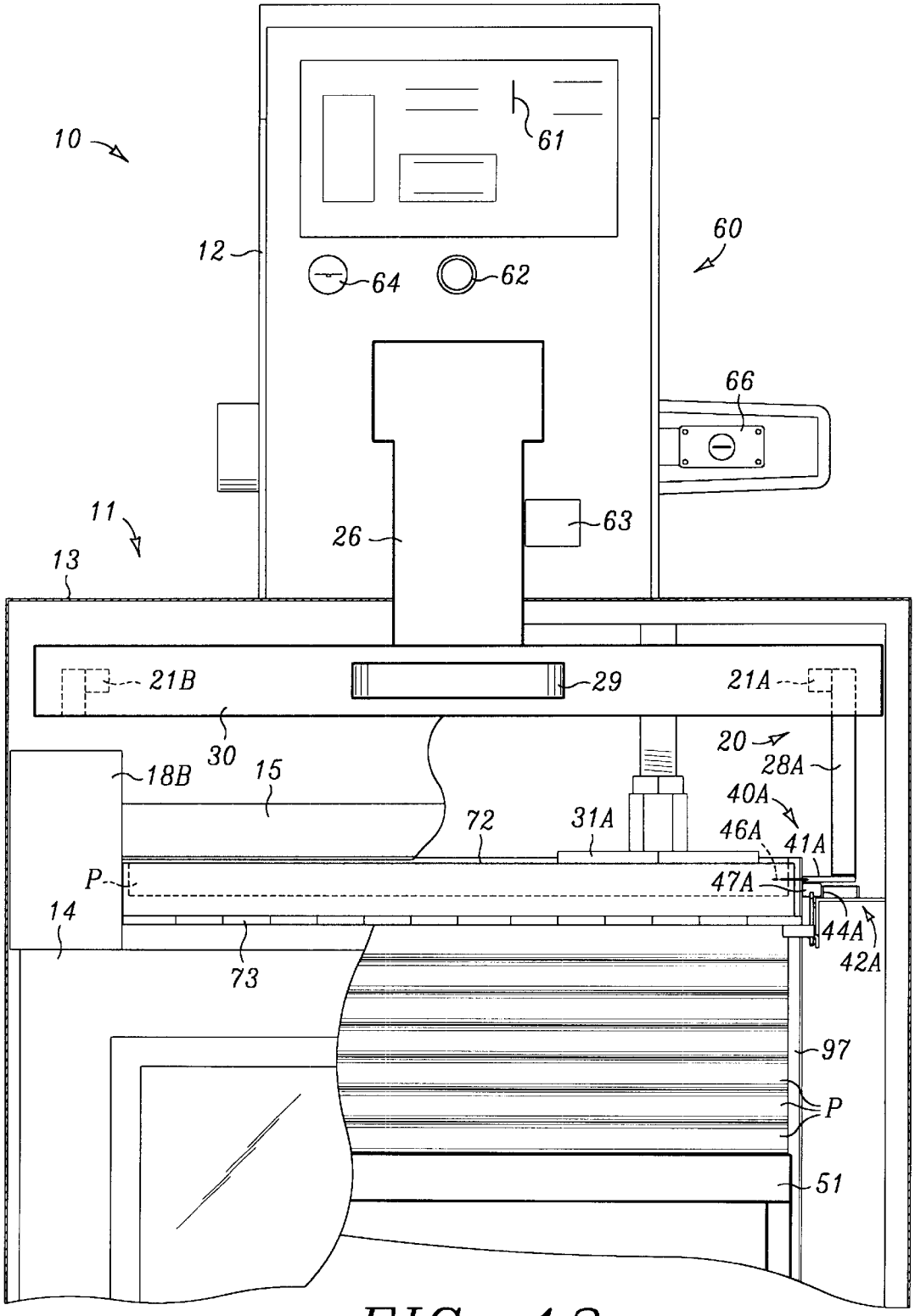
FIGS. 12 and 13 are representative partial cross-sectional front views showing a carriage, a forward transport assembly and a vend flap assembly for a single publication vending device.
Figure 13:
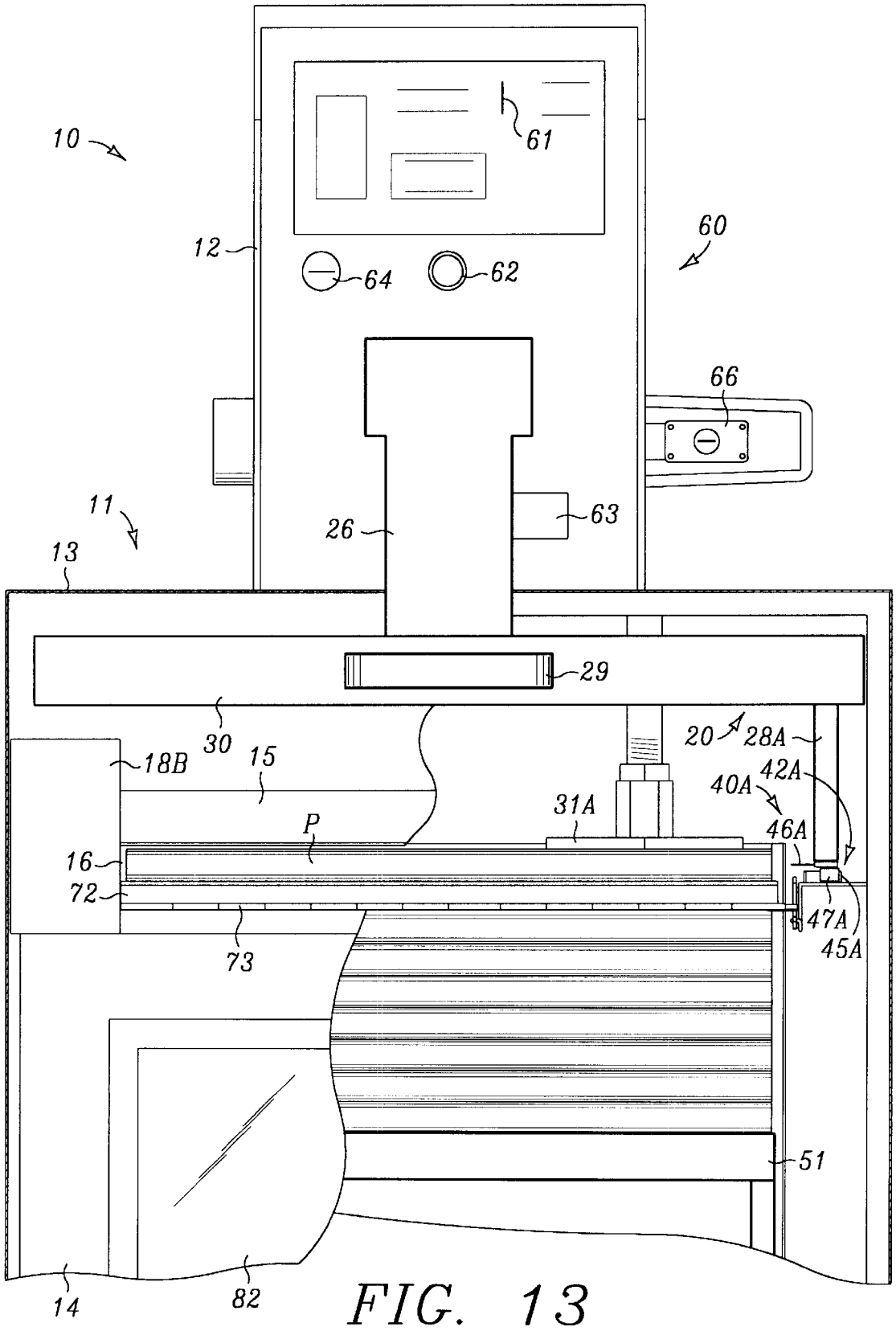

FIGS. 12 and 13 show single publication vending device 10 including housing 11 including payment and security system sub-housing 12, product storage and dispensing sub-housing 13 and door 14. Carriage assembly 20 and first forward transport assembly 40A are shown enclosed in housing 11. Housing 11 also includes publication vend port 16, through which publication P is discharged during a vend cycle. Drip shield 15 inhibits entry of rain or snow through publication vend port 16. Vend flap 72 is hingedley attached to product storage and dispensing sub-housing 13 by flap hinge 73. Bin 97 provides a containment and alignment means for publication P.

First advance arm housings 18A and 18B provide protection for first and second forward transport assemblies 40A and 40B shown in FIGS. 2 through 6. Crossbar 30 is shown connected at the distal ends of first carriage members 21A and 21B. Crossbar 30 includes pull 29 which provides a point at which the purchaser may grasp and pull crossbar 30. Hasp portion 26 is connected to and extends from crossbar 30 for latching cooperation with payment and security system sub-housing 12. First forward transport assembly 40A is shown including first advance arm 41A which is rotatably connected to first carriage member 21A by first advance arm connector 28A for reciprocating movement along first advance arm track 42A with the forward and rearward movement of first carriage member 21A.

First advance arm 41A includes first finger 46A extending from the distal end of first advance arm 41A. The position of first finger 46A in FIG. 12 corresponds generally to the position of first finger 46A in FIG. 4, that is, first finger 46A is shown inserted at publication interleaf B formed between adjacent pages of publication P. The position of first finger 46A in FIG. 13 corresponds generally to the position of first finger 46A in FIG. 5, that is, first finger 46A is shown withdrawn from publication interleaf B of publication P. Similarly, the position of vend flap 72 in FIG. 12 corresponds generally to the position of vend flap 72 in FIG. 8, that is, vend flap 72 is shown in an upright position inhibiting access through vend port 16. Likewise, the position of vend flap 72 in FIG. 13 corresponds generally to the position of vend flap 72 in FIG. 9, that is, vend flap 72 is shown in an open position permitting discharge and withdrawal of publication P through vend port 16.

Also shown to advantage in FIGS. 12 and 13 is first advance arm roller 47A attached near a distal end of first advance arm 41A for rolling contact with first advance arm track 42A. Upper travel limit 31A which assures that the elevation of the uppermost publication P is always consistent. Publication P is supported by product support platform 51 which supports and positions one or more publications P such that fold F of publication P lies substantially parallel to and coplanar with publication vend port 16.

FIGS. 12 and 13 also shows to advantage various components of payment and security system 60 which is enclosed within payment and security system sub-housing 12 and includes coin slot 61, coin return button 62, coin return slot 63 and, keyed latch assembly by-pass 64. Padlock 66, secures payment and security system 60 within payment and security system sub-housing 12. Also shown to advantage in FIGS. 7 through 9 are vend flap assembly 70 including vend flap 72 and flap latch assembly 75.

Figure 14:
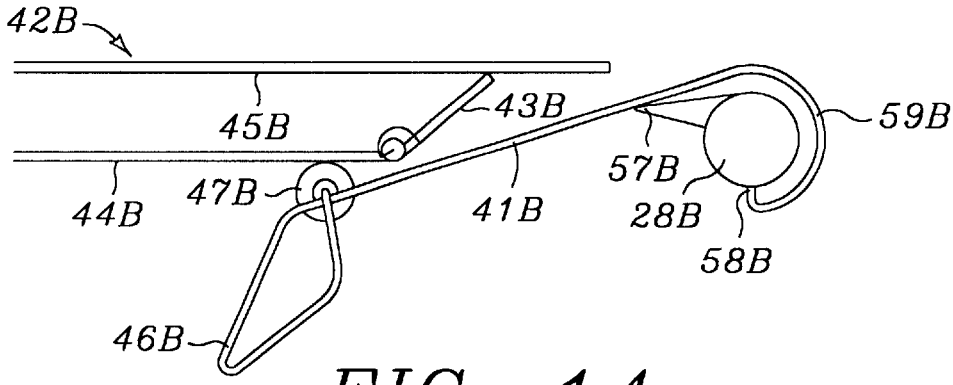
FIGS. 14 through 16 are representative top detail views showing alternate configurations for an advance arm for a single publication vending device.
Figure 15:
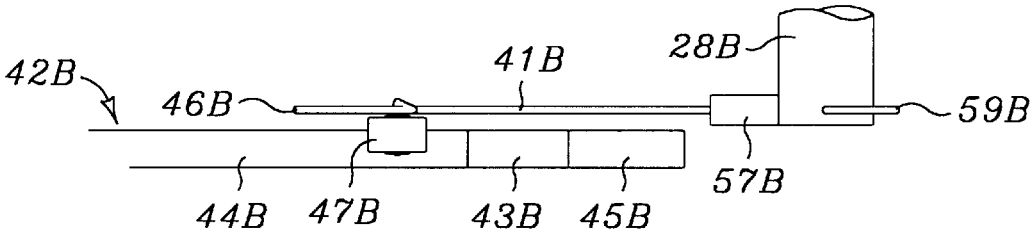
Figure 16:
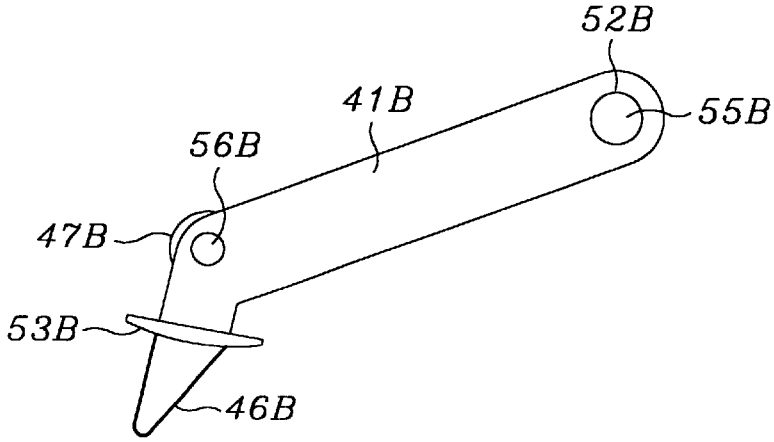

FIGS. 14 through 16 depict various embodiments of second advance arm 41B with its extending second finger 46B. As shown in FIGS. 14 and 15, second finger 46B is configured by bending a wire to form the respective arm and finger portions. Second finger 46B is configured having radiused portion 59B which wraps partially around the circumference of second advance arm connector 28B. Stop 57B provides means to prevent over rotation of first advance arm 41B towards publication P. Second finger 46B is attached to second advance arm connector 28B at hook end 58B. Also shown to advantage in FIGS. 14 and 15 is second advance arm roller 47B advancing through second advance arm track 42B. Second advance arm track 42B includes second diagonal delivery track portion 43B, second parallel delivery track portion 44B and second return track portion 45B.

FIG. 16 depicts another preferred embodiment of second advance arm 41B pivotable on pivot point 55B with its extending second finger 46B. Second finger 46B is configured as a thin, flat knife member. As shown in FIG. 16, second advance arm 41B includes in this embodiment hilt 53B which limits the extent to which second finger 46B inserts into a publication. Hilt 53B may also serve to align the side edges of the publication for discharge. Second finger 46B is configured having aperture 52B formed in a proximate end of second finger 46B through which second advance arm connector 28B is inserted through and about which second finger 46B is free to rotate. Also shown to advantage in FIG. 16 is second advance arm roller 47B rotatable connected to second advance arm 41B at roller pivot 56B.

Figure 17:
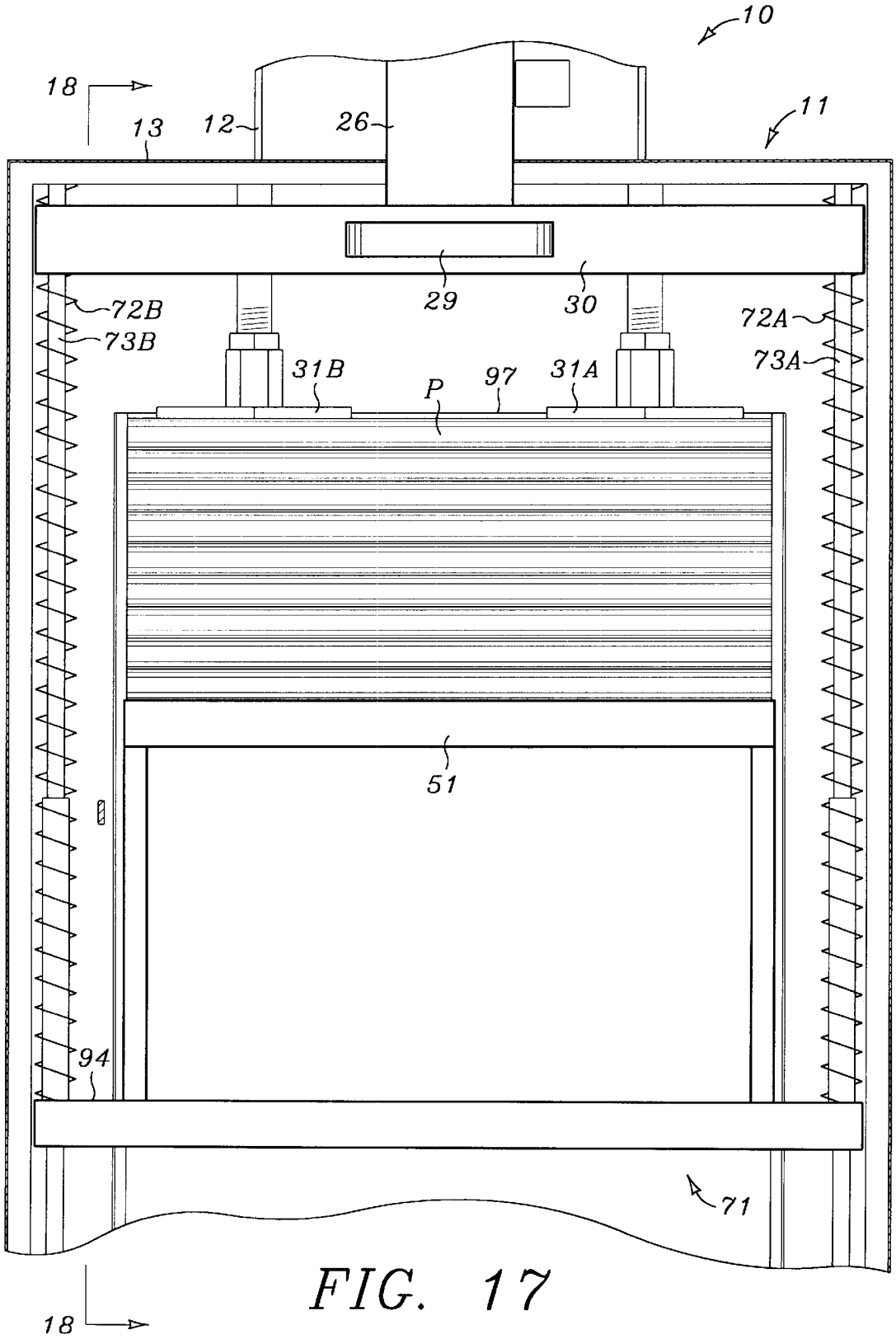
FIG. 17 is a representative partial cross-sectional front view showing a housing containing a product storage and elevator assembly for the single publication vending device.
Figure 18:
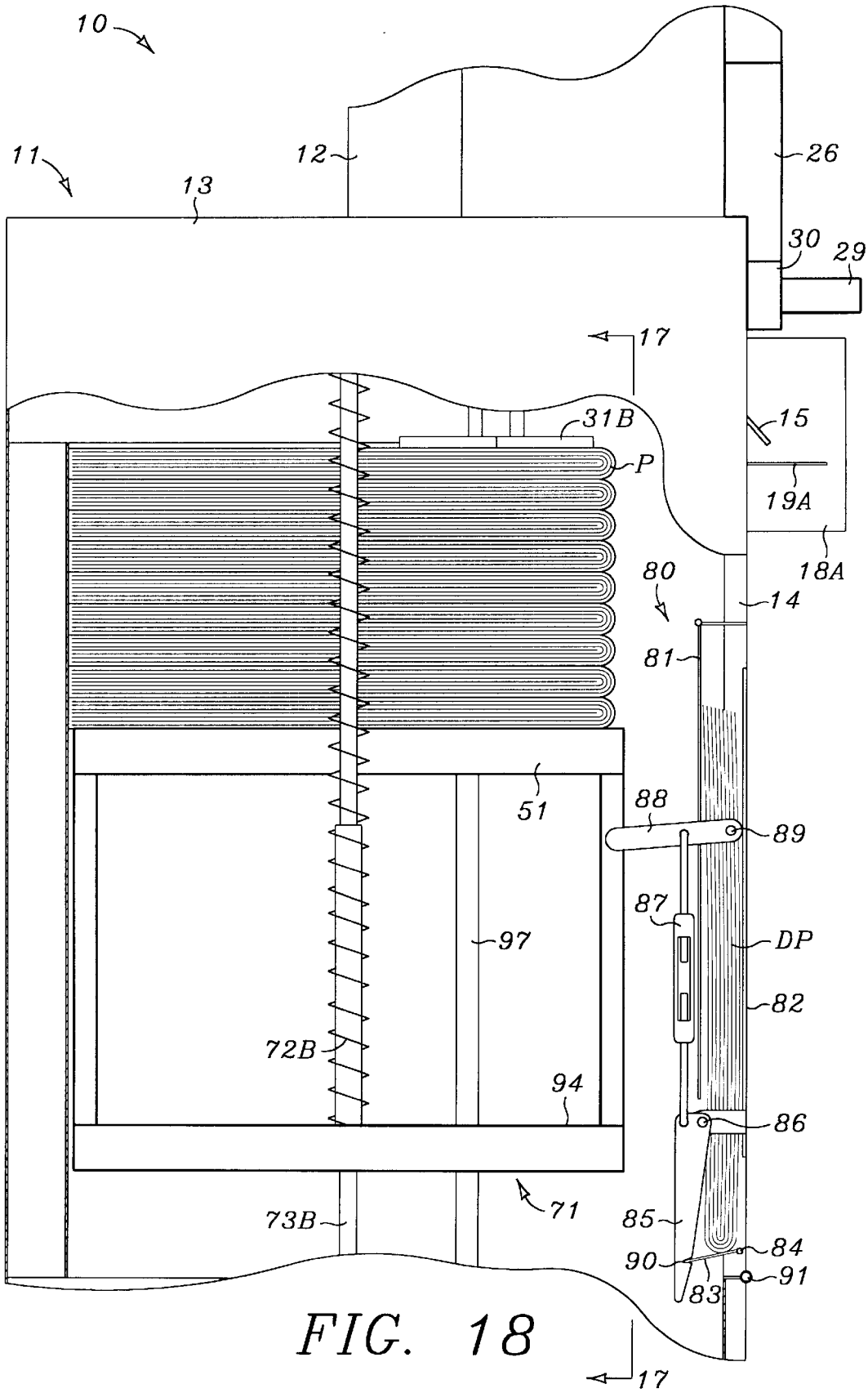
FIGS. 18 through 21 are representative partial cross-sectional side views showing a product storage and elevator assembly and a product display and release system for a single publication vending device.

FIGS. 17 through 21 show various aspects of product storage and elevator assembly 71 of single publication vending device 10. Single publication vending device 10 includes housing 11, including payment and security system sub-housing 12 (shown in FIGS. 17 and 18) and product storage and dispensing sub-housing 13. FIGS. 17 and 18 also show product storage and dispensing sub-housing 13 including first advance arm housing 18A having first finger extension slot 19A.

Figure 19:
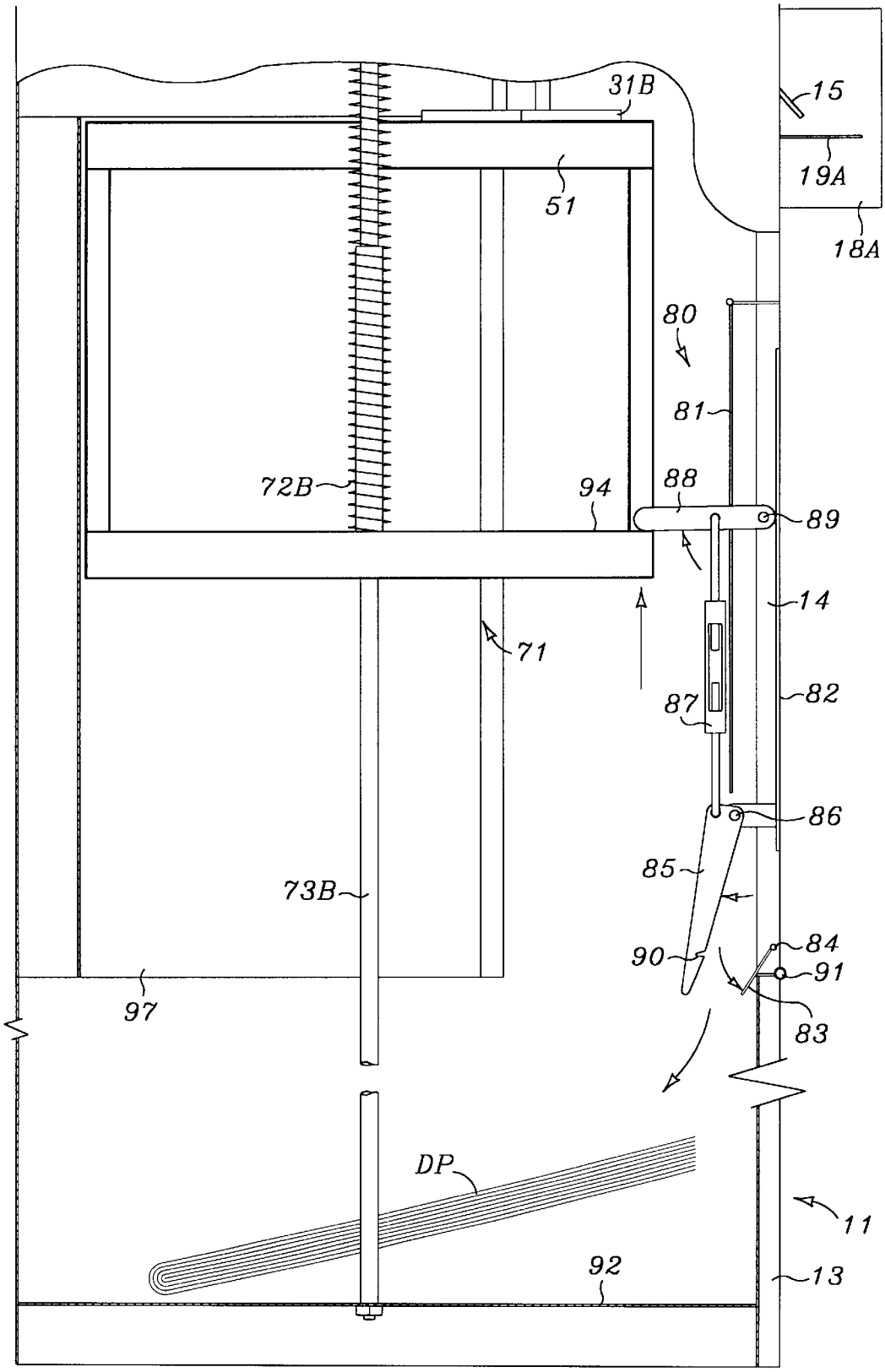
Figure 20:
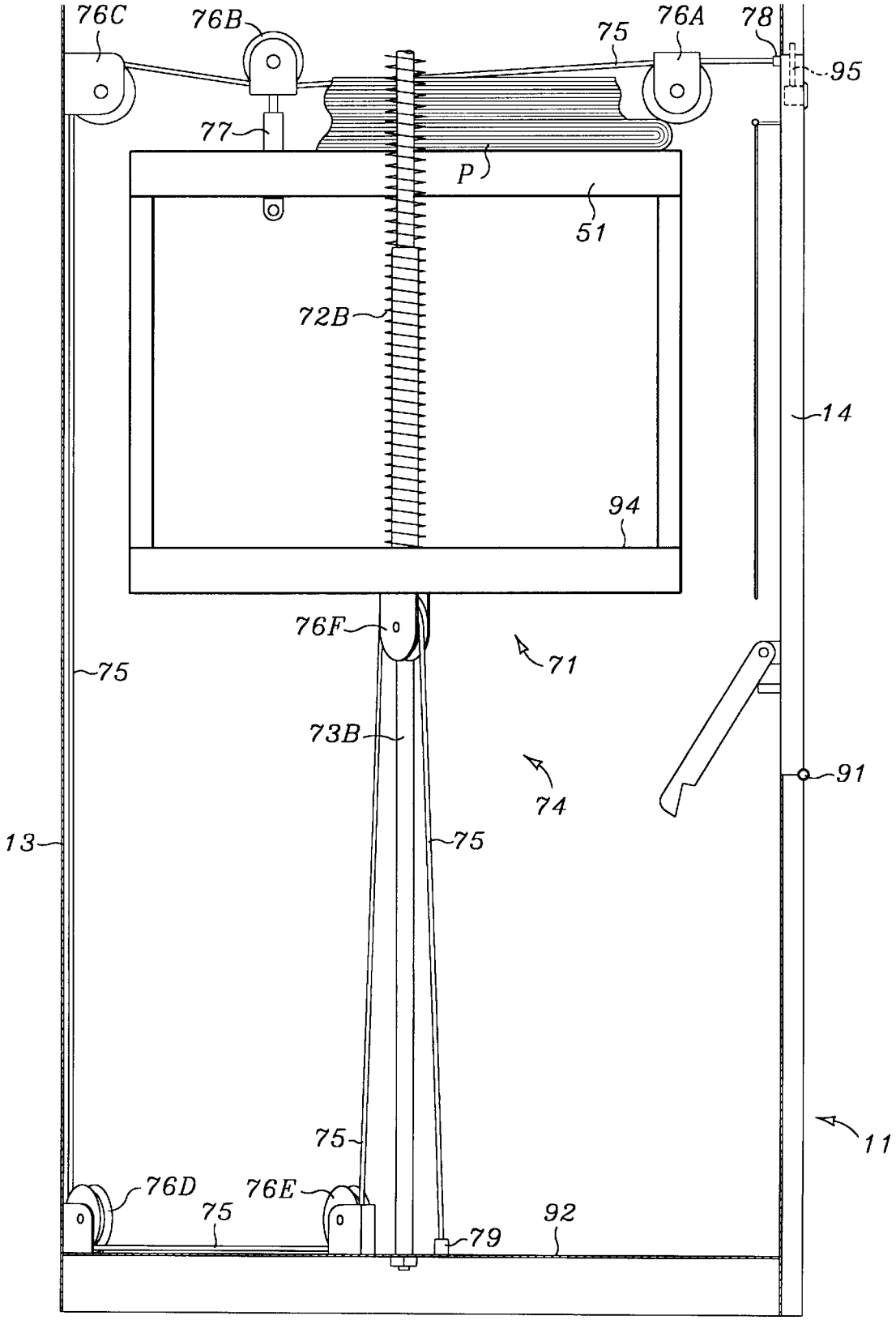
Figure 21:
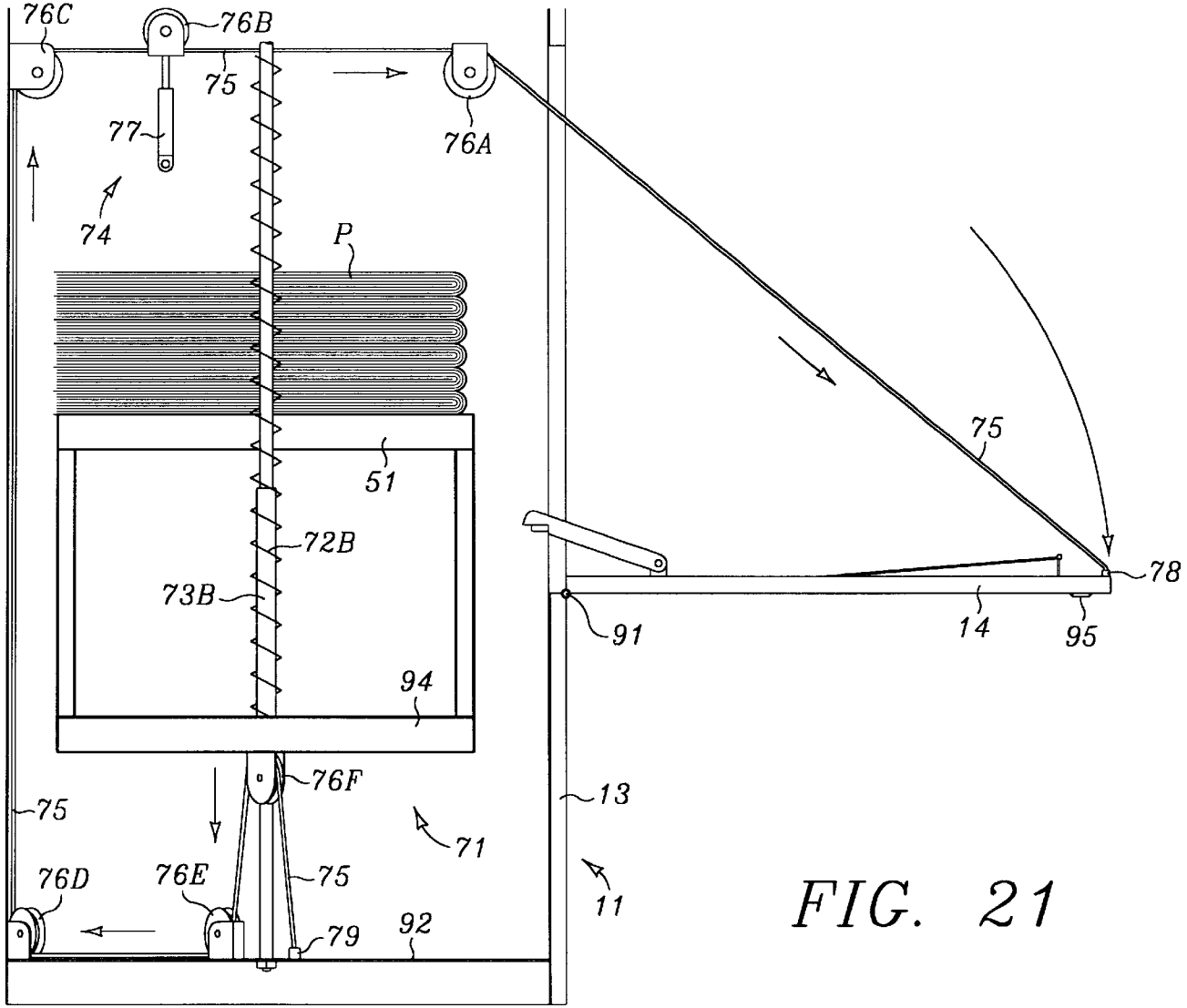

Door 14 is hingedly attached to product storage and dispensing sub-housing 13 by door hinge 91, (shown in FIGS. 18 through 21), and is secured against unauthorized access by key operated latch assembly 95, (shown in FIGS. 20 and 21). FIGS. 17 through 21 show product storage and elevator assembly 71 including elevator base portion 94 which is suspended from first and second elevator springs 72A and 72B. A first end of first and second elevator springs 72A and 72B are fixed to the upper inner surface of product storage and dispensing sub-housing 13 and a second end of first and second elevator springs 72A and 72B are connected to elevator base portion 94. First and second elevator springs 72A and 72B are positioned about first and second guide posts 73A and 73B respectively which provide lateral stability for elevator base portion 94. Product support tray 51 is supported by elevator base portion 94. As shown in FIGS. 17 and 18 a stack of publications P are positioned on product support tray 51 with first and second elevator springs 72A and 72B maintaining an upward force so that the upper surface of the uppermost publication is held in contact against upper travel limits 31A and 31B.

FIGS. 18 and 19 show single publication vending device 10 including product display and release system 80. Product display and release system 80 includes product display bay 81 attached to the inside surface of door 14 and is adapted or otherwise configured to contain display publication DP so that display publication DP appears in window 82. Product support 83 is hingedley connected to the inside surface of door 14 below product display bay 81 by product support hinge 84. Support retainer 85 is pivotally attached to product display bay 81 at retainer arm pivot 86. Retainer arm actuator 87 is connected between support retainer 85 and trip lever 88. Trip lever 88 is also pivotally attached to product display bay 81 at trip lever pivot 89. Display publication DP is inserted into product display bay 81 and product support 83 is positioned to support display publication DP in product display bay 81 as shown in FIG. 18. Support retainer 85 includes catch 90, into which an edge of product support 83 is inserted. In this manner, and as long as trip lever 88 is undisturbed, product support 83 will remain engaged with support retainer.

As shown in FIG. 19, when a last publication is removed from product support tray 51, elevator base portion 94 lifts engaging trip lever 88, pulling up on trip lever 88 and the connected retainer arm actuator 87 and support retainer 85. Product support 83 pivots away and display publication drops from product display bay 81, revealing a sold out sign or other advertisement, (not shown), through window 82.

FIGS. 20 and 21 show additional aspects of product storage and elevator assembly 71 of single publication vending device 10. In particular, FIGS. 20 and 21 show additional aspects of elevator down mechanism 74 for product storage and elevator assembly 71. Cable 75 is connected at a first end by door connector 78 to door 14, passing consecutively through blocks 76A, 76B, 76C, 76D, 76E and 76F and is connected at a second end to base member 92 of housing 11 by base connector 79. Tensioner 77 maintains tension along the length of cable 75. When door 14 is in a closed position as shown in FIG. 20, first and second elevator springs 72A and 72B maintain an upward force on elevator base portion 94 and the length of cable 75 is distributed in such a manner that the majority of slack is taken up below elevator base portion 94 between blocks 76E, 76F and base member 92. Alternately, when the door is opened, as shown in FIG. 21, cable 75, which is attached to door 14 at door connector 78, is pulled over blocks 76A, 76B, 76C, 76D, 76E and 76F forcing elevator base portion 94 to a lowered position allowing access to product support tray 51 for loading or unloading publications.

While this invention has been described with reference to the detailed embodiments, this is not meant to be construed in a limiting sense. Various modifications to the described embodiments, as well as additional embodiments of the invention, will be apparent to persons skilled in the art upon reference to this description. It is therefore contemplated that the appended claims will cover any such modifications or embodiments as fall within the true scope of the invention.

I claim:

1. A single publication vending device for vending a publication including at least two pages, a fold connecting the at least two pages, an interleaf formed between the at least two pages and a centerline lying substantially perpendicular to the fold, the single publication vending device comprising:

a housing including a publication vend port;

a product support platform enclosed within the housing for supporting the publication with the longitudinal axis of the fold of the publication lying substantially parallel to and substantially coplanar with the publication vend port;

a carriage assembly including a first carriage member connected to and slidingly disposed within the housing and a second carriage member connected to and slidingly disposed within the housing;

a forward transport assembly connected to the carriage for reciprocating movement with the carriage for advancing the publication forward through the publication vend port, the forward transport assembly including;

a pivotable first advance arm connected to the first carriage member, the first advance arm including a first finger positioned laterally to a first edge of the publication positioned on the product support platform, the pivotable first advance arm also including a first roller disposed in a first advance arm track including a first parallel delivery track portion attached to and extending from a first diagonal delivery track portion, a first diagonal delivery track portion hingedley attached to the first parallel delivery track portion by a first return hinge, the first diagonal delivery track portion being biased towards a closed position by a first return gate spring and a first return track portion positioned substantially parallel to the first parallel delivery track portion, the first roller configured for reciprocating travel along the first advance arm track with travel of the first carriage member;

a pivotable second advance arm connected to the second carriage member, the second advance arm including a second finger positioned laterally to a second edge of the publication positioned on the product support platform, the pivotable second advance arm also including a second roller disposed in a second advance arm track including a second parallel delivery track portion attached to and extending from a second diagonal delivery track portion, the second diagonal delivery track portion hingedley attached to the second parallel delivery track portion by a second return hinge, the second diagonal delivery track portion being biased towards a closed position by a second return gate spring and a second return track portion positioned substantially parallel to the second parallel delivery track portion, the second roller configured for reciprocating travel along the second advance arm track with the travel of the second carriage member;

a the first finger attached to and extending from the pivotable first advance arm, the first finger positioned laterally to a first edge of the publication, the first finger configured for transpositional travel in a plane substantially coplanar to the plane of the interleaf and towards the centerline of the publication; and the second finger attached to and extending from the pivotable second advance arm, the second finger positioned laterally to a second edge of the publication the second finger configured for transpositional travel in a plane substantially coplanar to the plane of the interleaf and towards the centerline of the publication.

2. The single publication vending device of claim further comprising:

a payment and security system including;

a payment receipt mechanism; and a latch assembly operatively connected between the payment receipt mechanism and the carriage, the latch assembly selectively operable by the payment receipt mechanism alternately between a secure mode prohibiting operation of the carriage and a vend cycle wherein operation of the carriage is permitted.

3. The single publication vending device of claim 2 wherein the payment receipt mechanism further comprises a coin operated vending device.

4. The single publication vending device of claim 2 wherein the payment receipt mechanism further comprises a token operated vending device.

5. The single publication vending device of claim 2 wherein the payment receipt mechanism further comprises a credit card operated vending device.

6. The single publication vending device of claim 2 wherein the payment receipt mechanism further comprises a paper currency operated vending device.

7. The single publication vending device of claim 1 further comprising a vend flap hingedley attached to the housing by a flap hinge biased to a closed position by a flap spring, the vend flap selectively covering the publication vend port during a security mode and selectively opening to permit b discharge of a publication during a vend cycle.

8. The single publication vending device of claim 1 further comprising:

an elevator assembly enclosed within the housing, the elevator assembly including;

an elevator, the product support surface connected to the elevator;

an elevator lift member connected to the elevator for upward movement of the elevator; and a lift stop for limiting upward movement of the elevator for positioning the interleaf of an uppermost publication coplanar to a plane of diagonal travel of the first finger and the second finger.

9. The single publication vending device of claim 1 further comprising a door hingedley connected to the housing.

10. The single publication vending device of claim 9 further comprising:

a product display and release system including;

a product display bay connected to the door including a window for displaying a display publication;

a display publication support hingedly attached to the door forming a lower support surface for supporting a publication in the product display bay;

a retainer attached to the display publication support;

a retainer actuator, the retainer pivotally connected to a first end of the retainer actuator;

a trip lever pivotally connected to a second end of the retainer actuator, the trip lever operable by the elevator lifting against the trip lever releasing the retainer which permits the display publication support to fall to an open position wherein the display publication drops out of the product display bay into the housing.

11. The single publication vending device of claim 1 wherein the carriage assembly further comprises a first slideable carriage member connected to a second slideable carriage member by a crossbar providing a means of forward motivation for the first carriage member.

12. The single publication vending device of claim 1 wherein the carriage forward advance mechanism further comprises a motor operativley connected to the carriage member providing a means of forward motivation for the carriage.

13. The single publication vending device of claim 1 wherein the carriage forward advance mechanism further comprises a manually operable crossbar attached to a first end of the first carriage member providing a means of forward motivation for the first carriage member.

14. The single publication vending device of claim 1 wherein the carriage return mechanism further comprises a spring connected at a first end to an interior surface of the housing and a second end attached to the carriage, biasing the carriage towards a first position wherein the single publication vending device is in a secure mode.

* * * * *